US010111480B2

(12) United States Patent
Pezzimenti

(10) Patent No.: US 10,111,480 B2
(45) Date of Patent: Oct. 30, 2018

(54) VENTED GARMENT

(71) Applicant: Nike, Inc, Beaverton, OR (US)

(72) Inventor: Luke A. Pezzimenti, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 93 days.

(21) Appl. No.: 14/877,199

(22) Filed: Oct. 7, 2015

(65) Prior Publication Data

US 2017/0099898 A1 Apr. 13, 2017

(51) Int. Cl.

| | |
|---|---|
| ***A41D 27/28*** | (2006.01) |
| ***A41D 1/02*** | (2006.01) |
| ***A41D 1/04*** | (2006.01) |
| ***A41D 3/02*** | (2006.01) |
| ***A41D 1/08*** | (2018.01) |
| ***A41B 1/08*** | (2006.01) |
| ***A41B 17/00*** | (2006.01) |
| ***A41B 9/00*** | (2006.01) |
| ***A41B 11/00*** | (2006.01) |

(52) U.S. Cl.

CPC ..... *A41D 27/28* (2013.01); *A41B 1/08* (2013.01); *A41B 9/00* (2013.01); *A41B 11/00* (2013.01); *A41B 17/00* (2013.01); *A41D 1/02* (2013.01); *A41D 1/04* (2013.01); *A41D 1/08* (2013.01); *A41D 3/02* (2013.01)

(58) Field of Classification Search

CPC .. A41B 9/001; A41B 2400/38; A41D 27/201; A41D 2300/32; A41D 2300/324

See application file for complete search history.

(56) References Cited

U.S. PATENT DOCUMENTS

| | | | |
|---|---|---|---|
| 317,711 | A | 5/1885 | Beinkmanf |
| 385,306 | A | 6/1888 | Helwitz |
| 1,252,187 | A | 1/1918 | Shane |
| 1,252,188 | A | 1/1918 | Shane |
| 1,612,010 | A | 12/1926 | Gray |

(Continued)

FOREIGN PATENT DOCUMENTS

| | | | |
|---|---|---|---|
| CN | 1864574 | A | 11/2006 |
| CN | 2927724 | A | 8/2007 |

(Continued)

OTHER PUBLICATIONS

"Nike Aeroloft," Nike. Last accessed Jan. 23, 2015 at: http://www.nike.com/us/en_us/c/running/aeroloft.

(Continued)

*Primary Examiner* — Shaun R Hurley
*Assistant Examiner* — Andrew W Sutton
(74) *Attorney, Agent, or Firm* — Shook, Hardy and Bacon L.L.P.

(57) ABSTRACT

The technology described herein relates to breathable, vented, and insulating garments. More particularly, the technology described herein relates to garments with chambers to retain an insulating fill material. Openings along seams between the insulating chambers may achieve evaporative moisture or air transfer from the inside (proximal to the body of a wearer) of the garment to the outside environment. In an aspect, the openings along the seams are offset with interior openings, wherein the interior openings are connected to the exterior openings by a passage between garment layers.

19 Claims, 18 Drawing Sheets

(56) References Cited

U.S. PATENT DOCUMENTS 1,788,731 A 1/1931 Mishel
2,084,173 A 6/1937 Wexler
2,121,836 A * 6/1938 Steinberger ..... A41D 27/06 2/236
2,353,984 A 7/1944 Barone
2,372,632 A * 3/1945 Webb ..... A41D 27/24 156/152
2,385,124 A 9/1945 Barone
2,464,380 A 3/1949 Daiber
2,466,911 A 4/1949 Raymond
2,851,390 A 9/1958 Chavannes
3,115,564 A 12/1963 Stacy
3,405,674 A 10/1968 Coates et al.
3,562,041 A 2/1971 Robertson
3,706,102 A 12/1972 Grenier
3,761,962 A 10/1973 Myers
3,771,170 A 11/1973 Leon
3,819,465 A 6/1974 Parsons et al.
3,852,144 A 12/1974 Parry
4,048,675 A 9/1977 Griffin
4,115,610 A 9/1978 Wortman
4,181,993 A 1/1980 McDaniel
4,185,327 A 1/1980 Markve
4,311,542 A 1/1982 Mueller et al.
4,370,754 A 2/1983 Donzis
4,496,407 A 1/1985 Lowery, Sr. et al.
4,560,427 A 12/1985 Flood
4,604,152 A 8/1986 Liukko
4,608,715 A 9/1986 Miller et al.
4,610,750 A 9/1986 Mango
4,625,336 A 12/1986 Derderian
4,693,771 A 9/1987 Payet et al.
4,713,131 A 12/1987 Obeda
4,716,598 A 1/1988 Bertram
4,737,212 A 4/1988 Emrich et al.
4,788,972 A 12/1988 Debusk
4,791,685 A 12/1988 Maibauer
4,938,817 A 7/1990 Langley
4,962,554 A 10/1990 Tesch
4,971,041 A 11/1990 Millikan et al.
5,003,902 A 4/1991 Benstock et al.
5,048,126 A 9/1991 McLaughlin
5,067,178 A * 11/1991 Katchka ..... A41B 9/001 2/247
5,165,115 A * 11/1992 Stanislaw ..... A41D 27/208 2/247
5,168,576 A 12/1992 Krent et al.
5,255,392 A * 10/1993 Stanislaw ..... A41D 27/201 2/247
5,267,519 A 12/1993 Uglene et al.
5,408,700 A 4/1995 Reuben et al.
5,445,863 A 8/1995 Slagle et al.
5,446,927 A 9/1995 Weldon
5,483,713 A 1/1996 Kikuchi et al.
5,665,196 A 9/1997 Combe et al.
5,692,245 A 12/1997 Reuben
5,713,079 A 2/1998 Simon et al.
5,787,502 A 8/1998 Middleton
5,799,600 A 9/1998 Reuben
5,885,679 A 3/1999 Yasue et al.
5,935,878 A 8/1999 Glasser
6,009,560 A 1/2000 McKenney et al.
6,018,819 A 2/2000 King et al.
6,049,908 A 4/2000 Bullock et al.
6,076,195 A * 6/2000 Klein ..... A41B 9/023 2/400
6,182,297 B1 * 2/2001 Duren ..... A41B 9/001 2/228
6,279,161 B1 8/2001 Johnston
6,547,327 B1 4/2003 Yates
6,579,403 B2 6/2003 Tolbert et al.
6,649,251 B1 11/2003 Druecke et al.
6,805,181 B2 10/2004 Blundell et al.
6,817,037 B1 11/2004 King
6,928,665 B1 8/2005 Yates
7,005,021 B2 2/2006 Kramer
7,051,373 B1 * 5/2006 Krall ..... A41D 1/04 2/69
7,094,714 B2 8/2006 Lap et al.
7,111,328 B2 9/2006 Bay
7,140,048 B2 11/2006 Wallerstein
7,578,005 B2 8/2009 Vereen
7,757,311 B2 7/2010 Garneau
7,827,624 B1 11/2010 Cole
7,926,124 B2 4/2011 Hunter et al.
8,028,386 B2 10/2011 Rock et al.
8,057,878 B2 11/2011 Lo et al.
8,070,905 B2 12/2011 Brennan
8,127,701 B2 3/2012 Harward
8,133,824 B2 3/2012 Harber
8,377,536 B2 2/2013 Cienski
8,399,085 B2 3/2013 Moore, III et al.
8,458,819 B1 * 6/2013 Hoole ..... A41B 9/001 2/247
8,518,511 B2 8/2013 Harward
D693,095 S 11/2013 Grant
8,578,516 B2 11/2013 Li
8,756,714 B2 6/2014 Reimer
D713,620 S 9/2014 Pezzimenti et al.
D713,621 S 9/2014 Pezzimenti et al.
D714,022 S 9/2014 Mong et al.
8,828,167 B2 9/2014 Hannon
8,840,745 B2 9/2014 Green
9,023,161 B2 5/2015 Ma et al.
9,138,060 B2 9/2015 Vainberg et al.
9,247,830 B2 2/2016 Waters et al.
9,392,825 B2 7/2016 Pezzimenti et al.
2003/0033656 A1 2/2003 Jaeger
2003/0126673 A1 7/2003 Yardley
2003/0208831 A1 11/2003 Lazar et al.
2004/0083538 A1 * 5/2004 Thomas ..... A41D 27/201 2/400
2004/0111782 A1 6/2004 Lenormand et al.
2005/0124256 A1 6/2005 Mason et al.
2006/0059601 A1 3/2006 Opitz et al.
2006/0165939 A1 7/2006 Hottner
2006/0185053 A1 8/2006 Wittmann et al.
2006/0240234 A1 10/2006 O'Neill et al.
2007/0026186 A1 2/2007 Chapuis
2007/0083985 A1 * 4/2007 Nathan ..... A41B 9/001 2/400
2007/0245448 A1 10/2007 Bury
2007/0294800 A1 12/2007 Huang
2008/0005823 A1 1/2008 Hung
2008/0127395 A1 6/2008 Blauer
2008/0295216 A1 12/2008 Nordstrom et al.
2009/0089911 A1 4/2009 Smith
2009/0233042 A1 9/2009 Sadato et al.
2010/0138977 A1 6/2010 Lin
2010/0143669 A1 6/2010 Abrams
2010/0281595 A1 * 11/2010 Gernes ..... A41B 9/001 2/69
2010/0287680 A1 11/2010 Johnson et al.
2010/0291825 A1 11/2010 Johnson et al.
2011/0119811 A1 5/2011 Rock et al.
2011/0296580 A1 12/2011 Demarest et al.
2012/0005829 A1 1/2012 Waters et al.
2012/0005831 A1 1/2012 Waters et al.
2012/0222189 A1 9/2012 Sokolowski et al.
2012/0328824 A1 12/2012 Cartabbia
2013/0014317 A1 1/2013 Ly
2013/0038104 A1 2/2013 Burns et al.
2013/0061366 A1 3/2013 Pezzimenti
2013/0177731 A1 7/2013 Moriarty
2013/0255103 A1 10/2013 Dua et al.
2013/0276201 A1 10/2013 Pezzimenti
2013/0277349 A1 10/2013 Pezzimenti
2014/0304896 A1 10/2014 Nordstrom et al.
2014/0349057 A1 11/2014 Blackford et al.
2015/0044943 A1 2/2015 Marshall et al.
2016/0183613 A1 * 6/2016 Martin ..... A41D 27/20 2/247
2016/0213077 A1 7/2016 Sung

(56) References Cited

U.S. PATENT DOCUMENTS

| | | | |
|---|---|---|---|
| 2016/0366963 | A1 | 12/2016 | Koshkaroff et al. |
| 2017/0028669 | A1 | 2/2017 | Regester et al. |
| 2017/0065005 | A1 | 3/2017 | Nordstrom |

FOREIGN PATENT DOCUMENTS

| | | | |
|---|---|---|---|
| CN | 201782000 | U | 4/2011 |
| EP | 1325976 | A1 | 7/2003 |
| EP | 2617306 | A1 | 7/2013 |
| JP | 2005226173 | | 8/2005 |
| KR | 20090113413 | | 11/2009 |
| WO | 2003057975 | | 7/2003 |
| WO | 2004082413 | A1 | 9/2004 |
| WO | 2013070086 | A1 | 5/2013 |
| WO | 2014062067 | A1 | 4/2014 |
| WO | 2014087161 | | 6/2014 |

OTHER PUBLICATIONS

"78678 North End Sport Pursuit 3-Layer Hybrid Soft Shell Jacket with Laser Perforation," Seasons Outfitters, seasonsoutfitters.com; Last accessed Jan. 23, 2015 at: http://www.seasonsoutfttlers.com/index.php/outerwear-32/waterproof/78678-pursuitladies-3-layer-light-bonded-hybrid-soft-shell-jacket-with-laser-perforation.html.

"Mavic Helium Jacket (Men's)," MEC, mec.ca Last accessed Jan. 23, 2015 at: http://www.mec.ca/product/5038-526/mavic-helium-jacket-mens/.

"Salomon Men's S-Lab Hybrid Jacket," Running Warehouse, runningwarehouse.com Last accessed Jan. 23, 2015 at: http://www.runningwarehouse.com/Salomon_Mens_S-Lab_Hybrid_Jacket/descpage-SMSLHJ.html.

"Women's Better than Naked™ Cool Jacket," The North Face®, thenorthface.com Last accessed Jan. 23, 2015 at: http://www.thenorthface.com/catalog/sc-gear/women-39-s-better-than-nakedcool-jacket.html.

"88680: Ventilate—Men's Seam-Sealed Insulated Jacket," Alphabroder, ashcity.com Last accessed Jan. 23, 2015 at: http://www.ashcity.com/en-ca/products/outerwear/insulated-seam-sealed/88680-ventilate-mens-nbsp-3bseam-sealed-insulated-jacket.html.

"W's C9 Loft Jacket," Houdini, houdinisportswear.com Last accessed Jan. 23, 2015 at: http://www.houdinisportswear.com/en/women/womens-c9-loft-jacket.

"Laser Perforated Jacket," Akris punto, Nordstrom, Item # 251033. Last accessed Jan. 23, 2015 at: http://shop.nordstrom.com/s/akris-punto-laser-perforated-jacket/3667112.

"Greenland Baffled Jacket," Marmot® For Life, marmot.com, #5067. Last accessed Jan. 23, 2015 at: http://marmot.com/products/details/greenland-baffled-jacket.

"Woman's Aconcagua Jacket," The North Face, thenorthface.com. Last accessed Jan. 23, 2015 at: http://www.thenorthface.com/catalog/sc-gear/womens-jackets-vests/women-8217-saconcagua-jacket.html.

"Rab Microlight Alpine Down Jacket," backcountry.com, Item # RAB0244. Last accessed Jan. 23, 2015 at: http://www.backcountry.com/rab-microlight-alpine-down-jacketwomens?CMP_SKU=RAB0244&MER=0406&skid=RAB0244-ORC-USXLUS16.

"Women's Old Navy Active Front-Quilted Jackets," Old Navy, oldnavy.gap.com Last accessed Jan. 23, 2015 at: http://oldnavy.gap.com/browse/product.do?vid=1&pid=172238002.

"Quilted Front Down Sweater Jacket," Moncler, Nordstrom, Item #803724. Last accessed Jan. 23, 2015 at: http://shop.nordstrom.com/s/moncler-quilted-front-down-sweater-jacket/3900159.

"'Pizzoli' Knit & Quilted Jacket," Boss Hugo Boss, Nordstrom, Item #73989. Last accessed Jan. 23, 2015 at: http://shop.nordstrom.com/s/boss-hugo-boss-pizzoli-knit-quilted-jacket/3782194.

"Barbour Mens Chukka Quilted Jacket Military Brown Navy," Barbour, coveredbridgecyclery.com Last accessed Jan. 23, 2015 at: http://www.coveredbridgecyclery.com/barbour-mens-chukka-quilted-jacket-militarybrown-navy-1423.html.

Angel, "Trend: Quilted Textures," youlookfab.com, Jul. 15, 2013. Last accessed Jan. 23, 2015 at: http://youlookfab.com/2013/07/15/trend-quilted-textures/.

European Extended Search Report dated Oct. 22, 2015 in European Patent Application No. 13778175.3, 6 pages.

Non-Final Office Action dated Oct. 9, 2015 in U.S. Appl. No. 13/449,783, 11 pages.

Final Office Action dated Jan. 15, 2016 in U.S. Appl. No. 13/449,783, 10 pages.

Notice of Allowance dated May 20, 2016 in U.S. Appl. No. 13/449,783, 10 pages.

European Search Report dated Nov. 18, 2016 in European Patent Application No. 16179320.3, 8 pages.

Bendzovski, Daniel, "Trend-sandwich: Exploring new ways of joining inspiration, such as different kinds of trends, through processes of morphing and melding different trendy garments and materials, for new methods, garment types, materials and expressions," Univ. of Boräs, 2015. http://www .diva-portal.org/smash/get/diva2: 825758/FULLTEXT01. pdf.

International Search Report and Written Opinion dated Dec. 20, 2016 in International Patent Application No. PCT/US2016/054798, 11 pages.

Non-Final Office Action dated Oct. 6, 2017 in U.S. Appl. No. 15/391,187, 12 pages.

International Search Report and Written Opinion dated Dec. 20, 2017 in International Patent Application No. PCT/US2017/055095, 13 pages.

Non-Final Office Action dated Mar. 20, 2017 in U.S. Appl. No. 15/391,187, 14 pages.

Final Office Action dated Jun. 1, 2017 in U.S. Appl. No. 15/391,187, 11 pages.

Final Office Action dated Feb. 22, 2018 in U.S. Appl. No. 15/391,187, 13 pages.

International Search Report and Written Opinion dated Dec. 18, 2017 in International Patent Application No. PCT/US2017/049833, 14 pages.

International Search Report and Written Opinion dated Dec. 18, 2017 in International Patent Application No. PCT/US2017/049840, 13 pages.

International Search Report and Written Opinion dated Dec. 20, 2017 in International Patent Application No. PCT/US2017/055094, 14 pages.

International Search Report and Written Opinion dated Dec. 20, 2017 in International Patent Application No. PCT/US2017/055308, 14 pages.

* cited by examiner

VENTED GARMENT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Aspects of the technology described herein relate to a garment with vents that allow moisture vapor to exit the garment while still retaining heat from a wearer's body. More particularly, the technology described herein relates to breathable, insulating, cold-weather garments that keep the wearer warm and dry during cold-weather activities.

BACKGROUND

With the desire to stay active year round, there is a need for breathable, insulating garments for use during physical activity in the cold-weather months. Conventional cold-weather garments may not allow for moisture vapor from perspiration and/or sufficient body heat to escape from the inside of the garment. This is especially the case when the cold-weather garment includes insulation, because the insulation may significantly reduce the moisture-vapor transmission rate through the garment. The trapping of moisture from perspiration may be particularly problematic for garments constructed from water-resistant fabrics. For instance, garments with fill material such as down or fibers are generally constructed of textiles that are resistant to the fill material penetrating the textile, either partially or entirely. Such fill-proof textiles may be created using treatments such as a durable water repellant (DWR) or by weaving or knitting a textile of sufficient weight to retain the fill material. Although these approaches often render the textile water-resistant, they may trap moisture vapor inside of the garment, which may then lead to discomfort for the wearer and may make the garment less effective as a cold-weather insulating garment.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The technology described herein generally relates to a vented garment that is insulating and breathable, which may facilitate the release of moisture vapor and heat from inside the garment. The vented garment in accordance with the technology described herein may be advantageous, for example, for a wearer undergoing physical exertion, such as aerobic activities (e.g., running, biking, hiking, snowboarding, skiing, etc.), physical labor, or other perspiration-inducing activities. When a person exercises, one possible physiological response is to cool down the body by releasing moisture in the form of perspiration. Perspiration still occurs in cold weather and might increase when a person wears heat-insulating garments. Therefore, an aspect of the technology described herein provides an insulating garment that may protect a wearer from external environmental conditions, while still allowing for moisture from perspiration to escape to the exterior environment. In addition, the technology may regulate an interior temperature of the garment by facilitating a transfer of heat through the garment.

The technology described herein allows moisture and/or heat to escape from the garment through a passage formed between, for instance, exterior and interior garment panels. In exemplary aspects, the interior garment panel may comprise an interior opening to the passage, and the exterior garment panel may comprise an exterior opening from the passage. Each passage may have multiple interior openings and exterior openings. And each garment may have multiple passages. The technology described herein offsets the interior openings from the exterior openings to provide an indirect passage for moisture vapor and/or air to exit the garment. In other words, the offset openings cause the moisture vapor to traverse the passage when exiting the garment instead of passing directly through the interior opening to the exterior opening. Moreover, the offset openings also cause heat produced by the body to traverse the passage prior to exiting the garment thereby preventing rapid heat loss. Thus, an object of the technology described herein is to facilitate moisture transport out of the garment while maintaining an appropriate amount of heat loss.

The insulating vented garment may be manufactured from a light-weight fabric and may comprise a number of insulating, down, or synthetic fiber-filled chambers, optionally separated by seams. In one aspect, the garment is woven or knit to comprise chambers created without seams. When seams are included in the garment, the seams separating the chambers may be spaced at varying intervals and may have any orientation and/or shape. In one example, the vented garment may be a standalone garment. The garment may be in the form of a vest covering a person's body core area, a jacket or coat with sleeves, pants, a total body suit, shirts, tights, base layers, and the like.

In one exemplary aspect, the seams may be formed by, for instance, actively adhering two panels (such as an interior and an exterior panel) of fabric together to form an exterior garment panel. The seams may be adhered together with, for example, a suitable adhesive tape material, by stitching or bonding the two panels of fabric together, or by both using the adhesive tape and stitching or bonding. In the case of certain fabrics, a tape may not be needed if the fabrics can be bonded without the use of tape.

In one example, interior openings may be formed in the interior panel at the seam area, exterior openings offset from the interior openings may be formed in the exterior panel at the seam area, and a passage may be formed connecting the interior openings with the exterior openings at the seam area. When the interior openings and exterior openings are both located in the seam area, then the seam may be formed by a method that does not seal the interior and exterior panels together within the seam area where the openings are located, such as by two parallel tracks of stitching or bonding thereby creating a passage that connects the interior openings to the exterior openings.

In another exemplary aspect, the insulating vented garment may comprise an additional interior panel that is affixed at one or more areas to an exterior garment panel having the chambers separated by seams. In this aspect, the interior openings may be formed in the additional interior panel and the exterior openings may be formed in the seam area between the chambers, where the interior openings are offset from the exterior openings. A passage is then formed in the space between the additional interior panel and the exterior garment panel having the chambers separated by the seams.

Additional objects, advantages, and novel features will be set forth in part in the description which follows, and in part will become apparent to those skilled in the art upon examination of the following, or may be learned by practice of the technology described herein.

BRIEF DESCRIPTION OF THE SEVERAL VIEWS OF THE DRAWING

The technology described herein is described in detail below with reference to the attached drawing figures, wherein.

DETAILED DESCRIPTION

Figure 1:
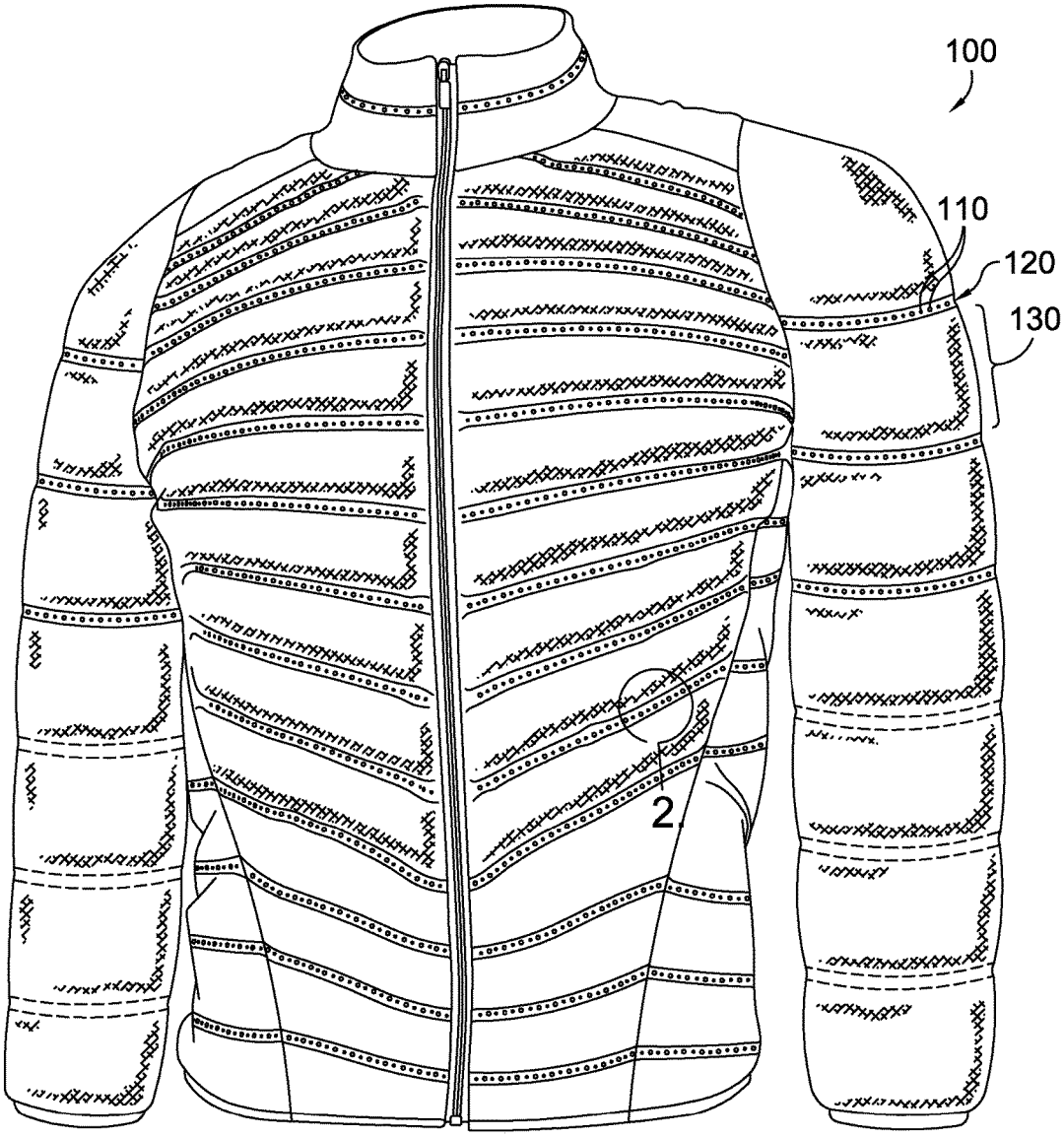
FIG. 1 is a view of an exemplary vented garment in accordance with the technology described herein.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

This technology is generally directed to a garment structure that facilitates the passive transfer of moisture and/or body heat from an internal portion of the garment to an external portion of the garment. For example, a garment may have an internal layer (e.g., interior panel) and an external layer (e.g., exterior garment panel), and aspects of the present technology are directing to transferring moisture vapor and/or heat from the internal layer to the external layer. The moisture vapor and/or heat can then dissipate or be dispersed into the space outside the garment.

In one instance of the present technology, one or more passages extend between the exterior and interior panels. In exemplary aspects, the interior panel comprises an interior opening, or inlet, to a passage, and the exterior panel comprises an exterior opening, or outlet, from the same passage. Each passage may have multiple interior openings and exterior openings. Each garment may have multiple passages.

In a further aspect, the technology described herein offsets the interior openings and the exterior openings to provide an indirect passage for moisture vapor and/or heat to pass from the interior panel to the exterior panel. In other words, the offset interior and exterior openings create passages that may include one or more changes in direction and that is not completely perpendicular to the respective planes of the interior panel and the exterior panel. The indirect passage may also provide resistance to air movement and moisture that helps regulate the amount of air and moisture leaving the garment. In one exemplary aspect, the materials of construction and the length of the indirect passages can be used in a garment to provide an appropriate amount of resistance to achieve the desired moisture and heat transmission. Thus, an object of the technology described herein is to facilitate moisture transport out of the garment while minimizing heat loss.

The interior and exterior openings may be positioned in various portions of the interior and exterior garment portions. For example, in one aspect the exterior openings are located in seam areas. The exterior openings might be created in seams using various techniques. For instance, after the seams are formed, the seams may then be perforated with a laser cutter, an ultrasonic cutting wheel, a water-jet cutter, a mechanical cutter, or the like to form the openings or perforations. With certain types of equipment, the affixing and perforating steps may be performed simultaneously, for example by using a welding and cutting wheel. The plurality of openings cut on the seams may be of different shapes and sizes and may create different patterns. The plurality of exterior openings may be continuous along the seams, or may be intermittently placed along the seams. In addition, the plurality of exterior openings may be placed strategically on seams located close to higher-perspiration areas (e.g., along the back of a wearer or under the arms of a wearer). The size and number of the plurality of exterior openings may be optimized to allow a desired level of ventilation, while still maintaining heat insulation close to the body of the wearer.

In one aspect of the technology, the interior openings to the passage are located in the seam area and/or on an additional interior panel that is affixed to an exterior garment panel having the seamed areas. In both instances, the interior openings are configured to be offset from the exterior openings. When the interior openings and exterior openings are both located in the seam area, then the seam may be formed by a method, such as, for example, two parallel tracks of stitching or bonding defining a passage between the tracks which does not fully seal the interior and exterior panels together at the seam. When the interior openings are located on the additional interior panel that is affixed to the exterior garment panel having the seamed areas, a passage may be formed in the space between the additional interior panel and the exterior garment panel having the seamed areas.

Materials of Construction

Vented garments in accordance with the technology described herein may be constructed using fabrics treated with down-proofing chemical treatments, and/or water repellants that may also act as down-proofing treatments, such chemical treatments referred to as DWR (durable water repellant). Although DWR is a waterproofing chemical treatment, in addition to waterproofing the fabric, it is also very useful for down-proofing fabrics, especially light and ultra-light weight fabrics. For example, fabrics that may particularly benefit from DWR treatment for down proofing are light fabrics (89 g/m$^2$ to 30 g/m$^2$) and ultra-light fabrics (29 g/m$^2$ or lighter). In some instances, down can have sharp shafts that can poke holes through light-weight fabrics, making the fabric more susceptible to tearing or down loss over time. Other types of fill material, such as polyester fibers, may lack the sharp shafts of down but are still challenging to contain within a light-weight textile. Heavier fabrics, such as fabrics with weights in the range of 90 g/m$^2$ to 149 g/m$^2$ or even 150 g/m$^2$ to 250 g/m$^2$ or higher, may be inherently more resistant to down and may or may not need a down-proofing treatment depending on the specific type of fabric/textile. Both heavy and light-weight fabrics may be used in garments in accordance with the technology described herein. Lighter weight fabrics may be more desirable in the manufacture of athletic and/or high aerobic activity insulating garments to minimize the garment weight.

In exemplary aspects, the insulating garment may be manufactured from a light-weight fabric and may comprise a number of insulating, down, or synthetic fiber-filled chambers, separated by seams. Seams separating chambers may be located at various areas of the garment, spaced at varying intervals, and may have any orientation and/or shape. The seams may be formed by actively adhering an exterior or outer panel and an interior or inner panel of fabric together with a suitable adhesive tape material to form an exterior garment panel, by stitching the two panels of fabric together, or by both using the adhesive tape and stitching. In the case of certain fabrics, a tape may not be needed if the fabrics can be bonded without the use of tape.

In one aspect, one or more portions of the insulating zones and/or the vented garment may be constructed using a weaving or knitting process (e.g., a weaving or knitting machine may be programmed to form various structures or constructions described herein). For example, such weaving or knitting processes may be used to form a seamless or nearly seamless garment or portions thereof.

Form Factor

The vented insulated garment described herein can take several forms. In one example of the garment in accordance with the technology described herein, the garment may be a standalone garment. The garment may be in the form of a vest covering a person's body core area, a jacket or coat with sleeves, pants, a total body suit, ski pants, a fleece, a clothing liner, and the like.

Alternatively, the garment in accordance with the technology described herein may be used as a removable interior-insulating panel having an exterior shell which may or may not be weather proof. This interior-insulating panel may also be worn as a standalone garment when detached from the exterior shell. Like in the previous example, the removable interior-insulating panel may be presented as a vest, a jacket, a body suit, and the like, depending on the type of garment and protection desired. For example, if the exterior shell is a long sleeved jacket, the interior-insulating panel may be presented as a vest, a jacket, or a jacket with removable sleeves to convert into a vest, depending on the amount of insulation desired. The interior-insulating panel may be fastened to the exterior shell by a zipper mechanism, buttons, hook-and-loop fasteners, or other suitable fastening mechanism or combination of fastening mechanisms.

Further, the vented garment may be engineered into an exterior shell. In other words, instead of being removable, an interior insulating and breathable panel in accordance with the technology described herein may be permanently attached to the exterior shell. This may be achieved by permanently affixing the exterior shell to the interior insulating and breathable panel at one or more areas using, for instance, stitching, bonding, welding, adhesives, and the like. Alternatively, an interior insulating and breathable panel may be integrated into an exterior shell panel by, for instance, integrally forming the interior insulating and breathable panel with the exterior shell using an engineered knitting and/or weaving process. Any and all aspects, and any variation thereof, are contemplated as being within the scope herein.

Definitions

Exterior panel: As used herein the phrase "exterior panel" describes a panel on the exterior of the garment. The exterior panel may be exposed to the external environment, or may not be exposed to the environment, for example, if the garment is worn under another garment or layer.

Exterior opening: As used herein the phrase "exterior opening" describes an opening in the exterior panel.

Interior panel: As used herein the phrase "interior panel" describes a panel inside of or interior to the exterior panel. A garment may have multiple interior panels.

Interior opening: As used herein the phrase "interior opening" describes an opening in an interior panel.

Water-Resistant Fabric: As used herein "water-resistant fabric" is a fabric that is substantially impervious to water. In some exemplary aspects, the term "water-resistant fabric" may be defined as a fabric that has greater than 1,000 mm of water resistance, which is the amount of water, in mm, which can be suspended above the fabric before water seeps through. However, values above and below this threshold are contemplated as being within the scope herein.

Non-breathable Fabric: As used herein "non-breathable fabric" is fabric that exhibits a low rate of moisture vapor transmission. In some exemplary aspects, a fabric may be defined as being non-breathable when it has a moisture vapor transmission rate less than 1000 ($g/m^2/d$), which is the rate at which water vapor passes through the fabric, in grams of water vapor per square meter of fabric per 24-hour period ($g/m^2/d$). However, values above and below this threshold are contemplated as being within the scope herein.

Weather-Resistant Fabric: As used herein "Weather-Resistant Fabric" is a fabric that is generally resistant to water and/or wind. In some instances, a weather-resistant fabric may comprise a fabric that is substantially impervious to water and exhibits a low rate of moisture vapor transmission.

Passage: As used herein the term "passage" is a space between garment layers where the garment layers are not directly connected. The passage is configured to and allows for the passage of moisture or moisture vapor and/or air.

FIG. 1 is a front view of a vented garment 100 in accordance with the technology described herein. The vented garment 100 in FIG. 1 may be made from conventional synthetic or natural fabrics. The fabrics may be water-repellent and/or fill proof, or alternatively, such as in the case of, for example, light-weight fabrics, they may be treated with waterproofing and/or down-proofing chemicals such as, for example, the chemical treatments referred to as DWR (durable water repellent). Since insulated garments may be down or synthetic thermal fiber filled, these treatments can help prevent the fill from poking through the fabric and help prevent water moisture from the environment from entering inside of the garment. However, as noted earlier, a downside of these chemical treatments on fabrics is that these treatments may decrease the ability for moisture vapor to evaporate from the garment.

Figure 3:
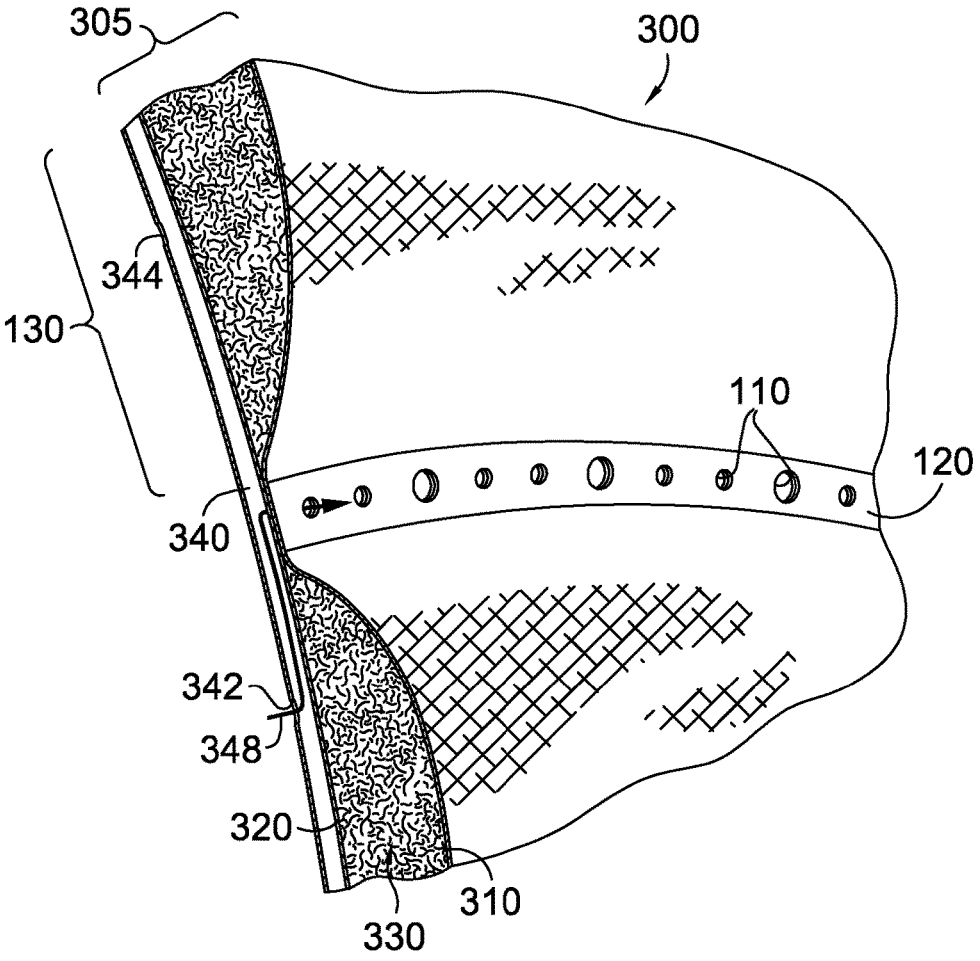
FIG. 3 is a close-up view of a section of a venting passage and insulating chambers from the vented garment in FIG. 1 in accordance with the technology described herein.

In an exemplary aspect, the vented garment 100 in FIG. 1 may be constructed by cutting out an interior panel and a corresponding exterior panel, for each section of the garment 100, from a fabric piece(s) (not shown). An adhesive tape suitable for the particular type of fabric may be placed on the interior face of one of the panels along predetermined sections of the panel to form chambers with a desired shape. Once the adhesive tape is set in place, the second panel may be aligned on top of the panel with the adhesive tape with its interior face facing the tape. Then, the two panels may be pressed together with sufficient force and/or energy applied, to activate the adhesive tape to create a bond(s) between the two panels. The adhesive tape may be activated by, for instance, heat, or ultrasonic energy, or any other type of applied energy. Once the fabrics are bonded, seams, such as seam 120 are formed where the seams 120 define or delineate chambers, such as chamber 130, in between each seam 120. In exemplary aspects, the interior panel and the exterior panel adhered together at the seams 120 form an exterior garment panel as shown in FIG. 3.

The chambers 130 may then be filled with down, or synthetic-insulating fibers. Depending on the size and/or shape of the chambers 130 formed, the chambers 130 may be filled with down or thermal-insulating fibers either manually or mechanically.

In a different example of the vented garment, depending on the fabric material used, the seams may be created without the use of an adhesive tape. For example, the fabric may be formed from fibers that are reactive to different stimuli such as heat, sound waves, mechanical pressure, chemicals, water, and the like. Upon application of the stimulus to the fabric, the fibers may undergo a transformation that causes the fibers to adhere or bond to each other. In this aspect, the stimulus could be applied to only those portions of the fabric where seams are desired. Any and all aspects, and any variation thereof, are contemplated as being within the scope herein.

In exemplary aspects, the seams 120 may be spaced apart in a generally horizontal orientation on the garment 100 as shown in FIG. 1. Or the seams 120 may be spaced apart in a generally vertical orientation on the garment 100. The spacing of seams 120 may vary, as may the relative orientation of the seams 120 and/or the shape of the seams 120, enabling the chambers 130 to be different shapes and/or sizes. In some aspects, the seams 120 may be spaced such that there is minimal space between the seams 120 thereby resulting in a smaller-sized chamber 130 with less insulating fill. In other aspects, the seams 120 may be spaced more widely apart to create a larger-sized chamber 130 with greater amounts of insulating fill. In some exemplary aspects, spacing between the seams 120 may be greater than the width of the seam 120. In other exemplary aspects, spacing between the seams 120 may be greater than twice the width of the seam 120, and so on. Exemplary distances between adjacent seams 120 may comprise, for example, between 1 cm and 20 cm, between 2 cm and 15 cm, and/or between 3 cm and 10 cm, although ranges above and below these values are contemplated herein. In aspects, the spacing between adjacent seams 120 may be variable depending upon the desired amount of insulation needed at different portions of the garment 100.

The seams 120 may be perforated during bonding, after bonding, and/or after filling the chambers 130. In exemplary aspects, openings 110 in the seams 120 may be formed using, for instance, a laser, an ultrasonic cutter, a water-jet cutter, a mechanical cutter, and the like. Provided the proper equipment, the seams 120 may be simultaneously formed and perforated in a single step to form the openings 110, although the seams 120 and the openings 110 may be formed in separate steps without departing from the scope of the technology described herein. In other aspects, the openings 110 may be integrally formed in the seams 120 during a knitting or weaving process. As well, the seams 120 themselves may be formed during the knitting or weaving process. For example, a Jacquard head may be used to integrally knit the seams 120 and the chambers 130. Moreover, this same knitting or weaving process may be used to integrally fill the chambers 130 using float yarns at the time they are created. Any and all aspects, and any variation thereof, are contemplated as being within the scope herein.

The plurality of openings 110 may provide ventilation and moisture management by allowing moisture vapor from perspiration and/or heat to escape to the exterior environment. The location of the openings 110 in the interior and exterior panels can vary in different aspects. For example, the openings 110 may penetrate both panels in the seam 120 (e.g., penetrate the exterior garment panel in the seam 120) and additional offset openings may be provided in an additional interior panel as shown in FIG. 3 and as discussed below. In another example, in a two-panel garment (e.g., in a garment comprising just the exterior garment panel without the additional interior panel), the holes or openings 110 in the exterior panel in the seam 120 can be offset from openings in the interior panel at the seam 120 as shown and discussed below with respect to, for example, FIGS. 6 and 7.

Figure 2:
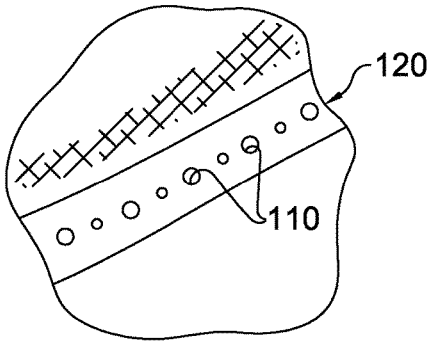
FIG. 2 is a close-up view of a venting seam from the vented garment in FIG. 1.

FIG. 2 is a close-up view of one of the seams 120. The seam 120 may be formed as described above (e.g., adhering an exterior panel to an interior panel at the seam 120 to form an exterior garment panel), may be presented in a straight line (as shown), in a curved line, in a wavy line, or any other shape that may be useful, for example in forming and defining the chamber 130 and being visually appealing at the same time. The plurality of openings 110 may be of the same size, or different sizes (as shown). The plurality of openings 110 may be of different shapes such as circular (as shown), triangular, rectangular, or any other shape desired. The plurality of openings 110 may be evenly spaced in a straight line, curvy line, zig-zag, or any other suitable shape for placing the plurality of openings 110 on the seam 120. Additionally, depending on the size of the individual openings, there may be multiple rows of openings 110 on each seam 120. The plurality of openings 110 may be presented continuously along the seam 120 (as shown), or may be presented intermittently along the seam 120, or may be strategically placed only in the areas of high perspiration such as along the back of a wearer, under the arms of a wearer, between the legs of a wearer, and the like.

The garment construction may become more apparent in reference to FIG. 3, where an angled cross-sectional view 300 of a small section of the garment 100 is shown. The garment 100 in accordance with the technology described herein may be constructed from an exterior panel 310 and a middle panel 320 that together form an exterior garment panel 305, and an interior panel 344. In exemplary aspects, one or more of the panels 310, 320, and/or 344 may be formed from a fabric that is substantially impervious to water and/or a fabric that exhibits a low rate of moisture vapor transmission. Moreover, in exemplary aspects, the interior panel 344 may comprise a mesh material, or a material having moisture-wicking or moisture-management properties. Including a mesh material or a material having moisture-wicking or moisture-management properties as the interior panel 344 may increase wearer comfort.

The seam 120 and the chamber 130 may be created as described above in reference to FIG. 1 (e.g., adhering the exterior panel 310 to the middle panel 320 at the seams 120 to form the exterior garment panel 305). The edges of the chambers 130 are formed by the seam 120. In other words, the seam 120 delineates and defines the chamber 130. The chamber 130 may then be filled with a fill 330, such as down or synthetic fibers. In aspects, once filled, the vapor transmission rate of the garment 100 may be reduced even when the fabric used to form the garment 100 comprises a breathable material because the chambers 130 may hinder the transmission of moisture vapor through the garment 100. The openings 110 extending through the seam 120 may comprise exterior openings in that they open to the external environment.

In exemplary aspects, the interior panel 344 may be somewhat loosely affixed to the exterior garment panel 305 at one or more locations such that the interior panel 344 may be spaced apart from the exterior garment panel 305 at areas where it is not affixed. In other words, a void or space 340 may be formed between the interior panel 344 and the inner-facing surface of the middle panel 320, where the space 340 may function as a passage for transmission of moisture vapor and/or air. The interior panel 344 comprises a plurality of interior openings, such as interior opening 342. The openings 342 may be thought of as interior openings in that they do not directly communicate with the external environment in contrast to the exterior openings 110. The interior openings 342 on the interior panel 344 are configured such that the interior openings 342 are offset from the exterior openings 110. In other words, there is not a direct communication path between the exterior openings 110 and the interior openings 342. This is indicated in FIG. 3 by the arrow 348 which indicates the route that moisture vapor and/or air would traverse when traveling, namely: 1) from the wearer's body, 2) through the interior opening 342, 3) into the space 340, and 4) out the exterior opening 110 where the moisture vapor may be discharged into the external environment.

The interior openings 342 in the interior panel 344 may be distributed throughout the interior panel 344 and/or may be localized in certain areas depending on the level of ventilation and/or breathability needed in a certain area. In one exemplary aspect, the interior openings 342 on the interior panel 344 are configured to not overlap with the exterior openings 110 associated with the exterior garment panel 305. In another exemplary aspect, the distribution of the interior openings 342 in the interior panel 344 may be configured such that a majority of the interior openings 342 (e.g., greater than 50%, 70%, 80%, or 90%) do not overlap with the exterior openings 110.

The size and number of the openings 342 and 110 may be adjusted to provide different ventilation and breathability characteristics, while still maintaining the structural integrity of the fabric, and maintaining a high level of thermal insulation. For instance, a larger size and greater number of openings 342 and 110 in portions of the garment 100 may provide a higher degree of ventilation and breathability characteristics to these portions. In another example, a smaller size and a fewer number of openings 342 and 110 in other portions of the garment 100 may provide for a lower degree of ventilation and breathability characteristics. Thus, by adjusting the size and/or number of the openings 342 and 110, different ventilation and breathability characteristics may be imparted to different portions of the garment 100. In exemplary aspects, the width size of each individual opening 342 and 110 may range anywhere from 0.1 mm to 5 mm, and the spacing between each individual opening 342 and 110 measured from edge to edge, may range anywhere from 0.5 mm to 10 mm. Other sizes and/or spacing of openings 342 and 110 may be used without departing from the scope of the technology described herein.

Figure 4:
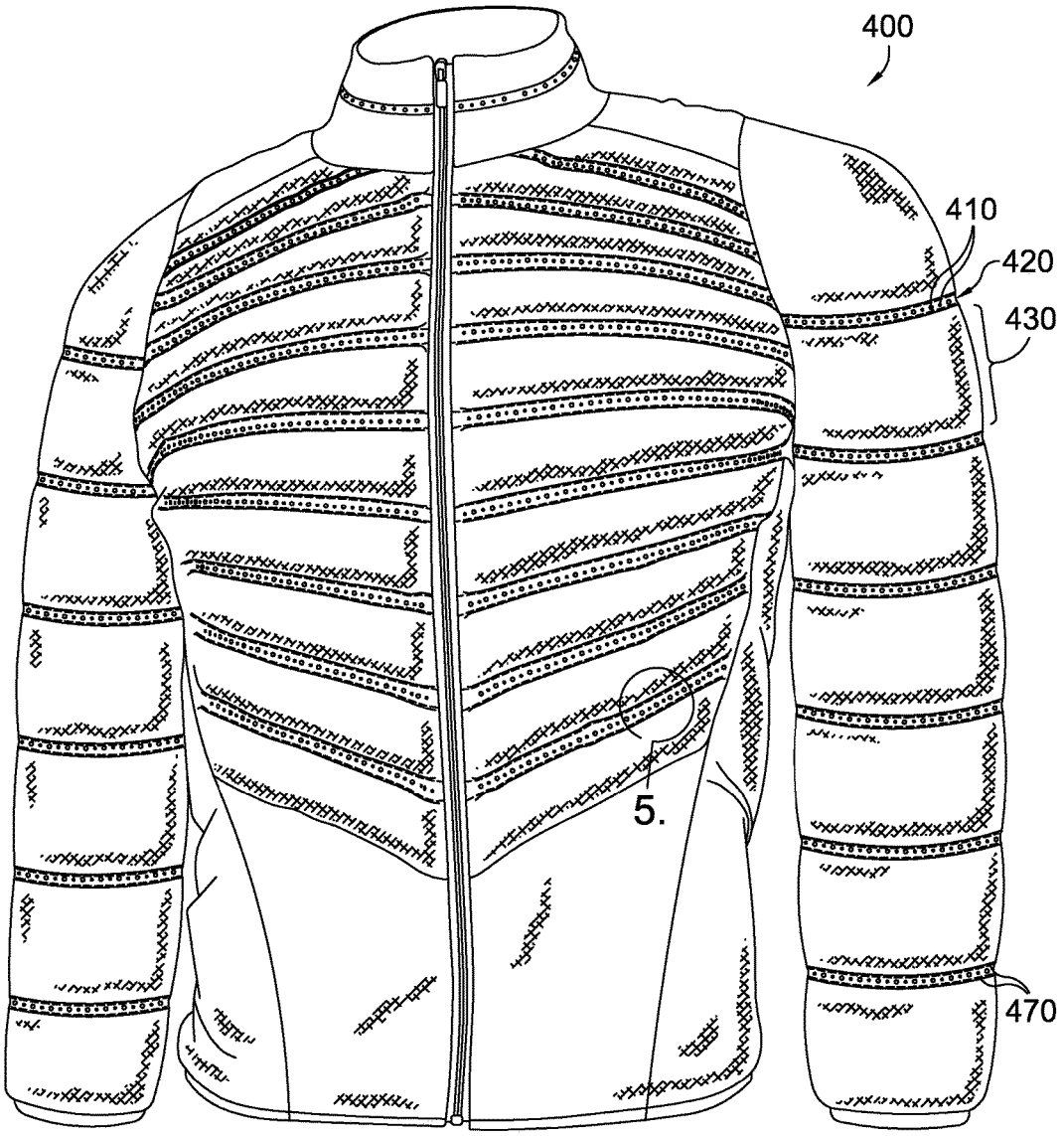
FIG. 4 is a view of a different exemplary vented garment in accordance with the technology described herein.
Figure 5:
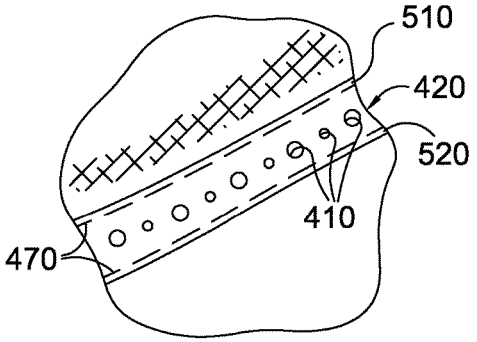
FIG. 5 is a close up view of a venting seam with stiches from the vented garment in FIG. 4 in accordance with the technology described herein.

Now, in reference generally to FIGS. 4-7, and particularly to FIG. 4, a front view of another different vented garment 400 is shown in accordance with an aspect of the technology described herein. With respect to the garment 400, the garment 400 may comprise an exterior panel adhered to an interior panel at seams 420 to form an exterior garment panel, where the seams 420 define chambers 430 that may be filled with a fill material. But the garment 400 may not have an additional interior panel as described for the garment 100. The vented garment 400 in FIG. 4 may be constructed in a fashion similar to that described above with regard to the garment 100 shown in FIG. 1 to form the seams 420. Moreover, the seams 420 may be further reinforced by adding stitching 470 along their upper seam boundary 510 and/or lower seam boundary 520, as can be seen in the close up view of FIG. 5. Although stitching is shown in FIG. 5, other methods of selectively affixing the seam 420 are contemplated herein such as use of adhesives, bonding, spot welding, and the like. Stitching 470 may be applied mechanically and/or by hand, and may use any type of thread, whether natural or synthetic. Likewise, stitching 470 may be applied before or after openings 410 are formed and/or before or after the chambers 430 are filled. In one aspect, the part of the seam 420 between the upper seam boundary 510 and the lower seam boundary 520 is configured to remain open to form a passage for moisture vapor and/or air to pass between the exterior and interior panels.

The vented garment 400 may be vented using offset openings within the seams 420. In other words, the exterior openings 410 in the garment's exterior panel may be offset from openings in the garment's interior panel (better shown in FIGS. 6 and 7) at the seams 420. The offset openings force moisture to pass through a passage within the seam 420 formed between the interior and exterior panels. The arrangement of the exterior and interior openings is illustrated with more detail in FIGS. 6 and 7.

Figure 6:
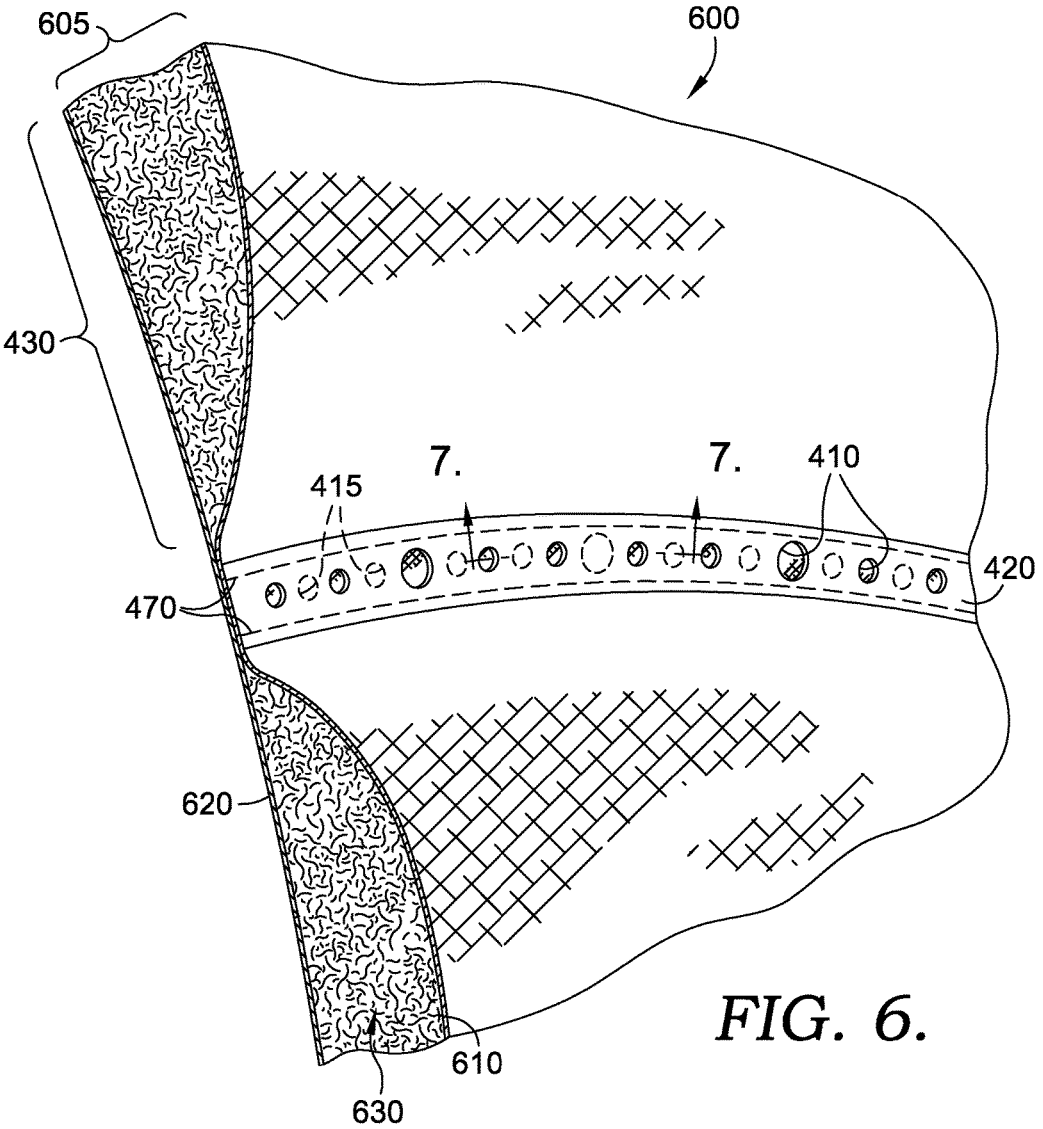
FIG. 6 is a close-up view of a section of the venting seam from the garment of FIG. 4 in accordance with the technology described herein.

FIG. 6 shows an angled cross-sectional view 600 of a small section of the garment 400. The garment 400 in accordance with the technology described herein may be constructed from an interior panel 620 and an exterior panel 610, where the interior panel 620 is affixed to the exterior panel 610 at the seam 420 to form an exterior garment panel 605. The seam 420 delineates and defines in part the chambers 430. The chambers 430 may then be filled with fill 630, such as down or synthetic fibers.

In the example shown in FIG. 6, the seam 420 comprises both exterior openings 410 and interior openings 415 (shown as dashed circles) that are offset from the exterior openings 410. The exterior openings 410, in some exemplary aspects, are formed just through the exterior panel 610 and may be open to or in communication with the external environment, while the interior openings 415 are formed just through the interior panel 620 and are not in direct communication with the external environment. As used herein, the term "offset" means the interior area of an exterior opening 410 does not overlap with the interior area of the interior opening 415. The offsetting of the exterior openings 410 from the interior openings 415 forces moisture and/or heat exiting the garment 400 to traverse a passage within the seam 420 connecting the interior openings 415 and exterior openings 410 as shown in FIG. 7.

Figure 7:
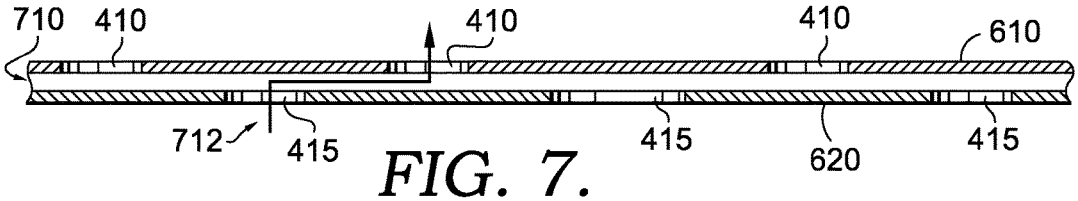
FIG. 7 is a cross-sectional view of a small section of the seam area in FIG. 6, where the insulating chambers are shown in relation to the openings in the seams in accordance with the technology described herein.

FIG. 7 provides a cross-section of the seam 420 to illustrate the offset nature of the exterior openings 420 and the interior openings 415 according to an aspect. As previously described and as shown in FIG. 5, the seam 420 is formed by affixing in part the exterior panel 610 and the interior panel 620 at the upper seam boundary 510 and the lower seam boundary 520. By just affixing the panels 610 and 620 at the upper seam boundary 510 and the lower seam boundary 520, a passage or space 710 is maintained between the exterior panel 610 and the interior panel 620 as shown in FIG. 7. Thus, as shown by the arrow 712, moisture vapor and/or air would leave the wearer's body by traveling through the interior opening 415, traversing the passage or space 710, and exiting via the exterior opening 410 where it can be dissipated into the external environment. The exterior openings 410 and the interior openings 415 are shown as evenly spaced and/or sized in FIGS. 6 and 7, but other arrangements are possible as described herein.

Like the vented garment 100 of FIG. 1, the vented garment 400 in FIG. 4 may be made from conventional synthetic or natural fabrics. The fabrics may be water repellent and down proof, or alternatively, such as in the case of ultra-light fabrics (29 g/m$^2$ or lower) and light-weight fabrics (89 g/m$^2$-30 g/m$^2$), the fabrics may need to be treated with waterproofing and down-proofing chemicals, such as, for example, the chemical treatments referred to as DWR (durable water repellent).

In some exemplary aspects, the insulating chambers in the vented garment in accordance with the technology described herein may be formed by welding separate pieces of fabric at each seam, or as discussed earlier, may be formed by pressing two whole panels with adhesive tape in strategic places in between the two panels. In the example where the chambers may be formed by welding separate pieces of fabric at each seam, this would allow for the introduction of different textures, colors, or functionalities by introducing different types of fabrics at different sections of the garment. Further, as described earlier, in one aspect, one or more portions of the insulating zones and/or the vented garments are constructed using an engineered weaving or knitting process (e.g., program a weaving or knitting machine to form these structures).

Figure 8:
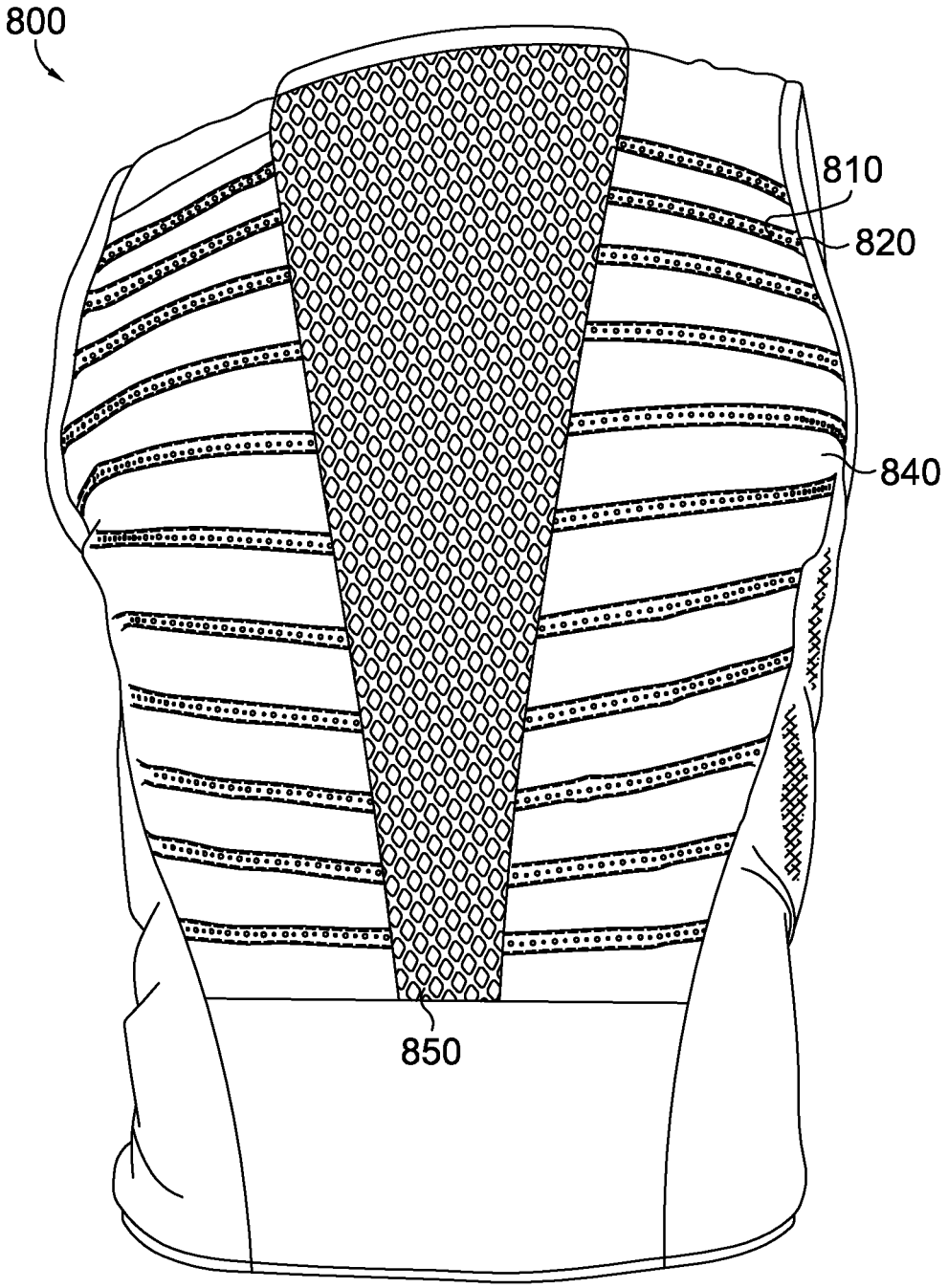
FIG. 8 is an additional exemplary vented garment that comprises a mesh back section in accordance with the technology described herein.

Further, the vented insulating garment examples shown in the examples of FIG. 1 and FIG. 4 are vented cold-weather jackets or coats. However, the insulating vented garments in accordance with the technology described herein may also be constructed in the form of vests, pants, overalls, gloves, hats, and the like. FIG. 8 is an example of a vest 800 in accordance with the technology described herein. As seen in FIG. 8, the vest 800 may have seams 820 with a plurality of openings 810, forming thermally insulating chambers 840, which may be filled with down, or any other thermally-insulating material, such as polyester fibers. In exemplary aspects, the insulating portions of the vest 800 may be formed as shown in FIG. 3 and/or the insulating portions of the vest 800 may be formed as shown in FIGS. 5-7. Any and all aspects, and any variation thereof, are contemplated as being within the scope herein. The vest 800 may be used as a light-weight, breathable, thermal-insulation garment, for example by a runner. The vest 800 may comprise a mesh vent area 850 to provide additional ventilation.

Figure 9:
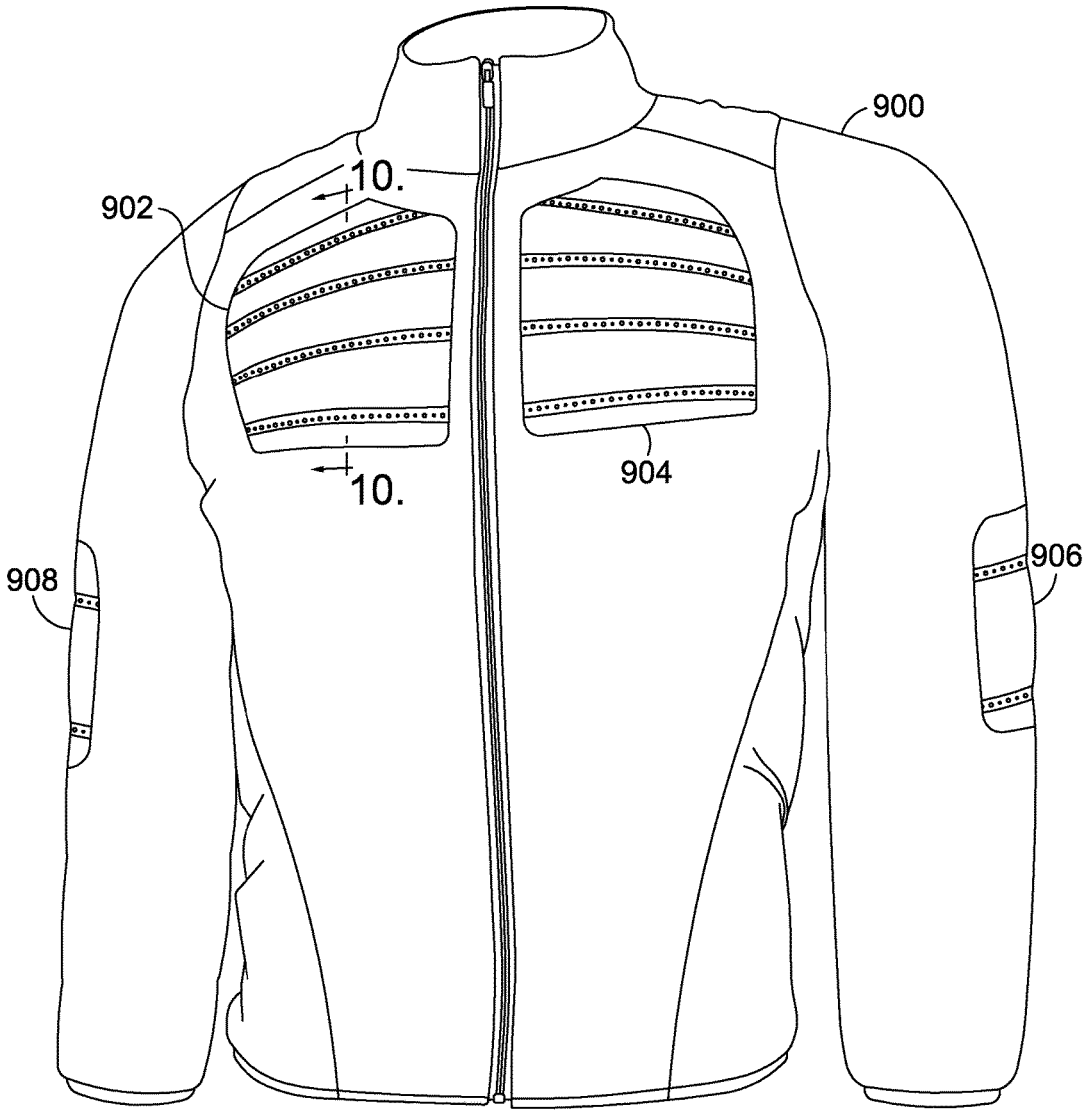
FIG. 9 is a view of an additional exemplary vented garment with localized vented-insulation sections in accordance with the technology described herein.

In various embodiments, the vented insulation zones as described herein may be located in parts of the garment instead of throughout the garment. FIG. 9 shows a garment 900 with a right-chest vented insulation zone 902, a left-chest vented insulation zone 904, a left-arm vented insulation zone 906, and a right-arm vented insulation zone 908. The vented insulation zones 902, 904, 906, and 908 may be located to maximize the retention of heat while still allowing for moisture venting. For example the vented insulation zones 902, 904, 906, and 908 may be located in areas of the body that produce more perspiration or areas that produce more heat or need an increased amount of vapor escape, such as the chest region, thighs, and the like. Another example is that the insulation zones 902, 904, 906, and 908 may be located in regions of the body that are more sensitive to cold. The insulation zones 902, 904, 906, and 908 may also be located based on the comfort of the wearer when exercising.

Figure 10:
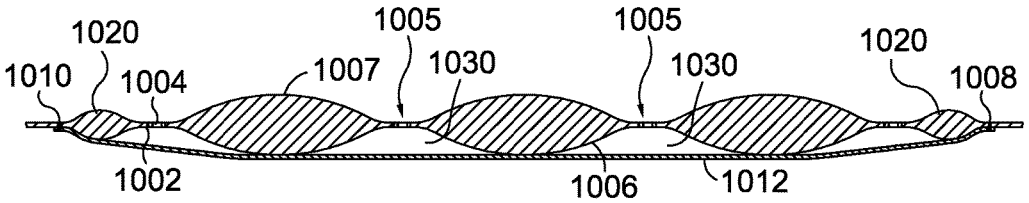
FIG. 10 is a cross-sectional view of the a localized vented-insulation section in FIG. 9 in accordance with the technology described herein.

Turning now to FIG. 10, a cross-section of the right chest vented insulation zone 902 is provided. The right-chest vented insulation zone 902 can be installed within the garment 900 by, for instance, cutting out a portion of the garment 900 and adding the insulation zone 902 in place of the cutout area. The insulation zone 902 is joined to the garment 900 at seam 1008 and seam 1010. The right-chest vented insulation zone 902 comprises chambers 1020 formed by joining an interior panel 1006 and an exterior panel 1007 at one or more seams 1005 to form an exterior garment panel. In one exemplary aspect, the seams 1005 comprise offset exterior openings 1004 and interior openings 1002. This configuration is similar to that shown in, for example, FIGS. 6 and 7. Alternatively, the seams 1005 may comprise exterior openings 1004 and the interior openings may be formed in a panel 1012 that is attached to the interior-facing side (next to the wearer) of the interior panel 1006 of the garment, where a passage or space 1030 is formed between the panel 1012 and the interior panel 1006. This configuration would be similar to that shown in FIG. 3. Any and all aspects, and any variation thereof, are contemplated as being within the scope herein.

Figure 11:
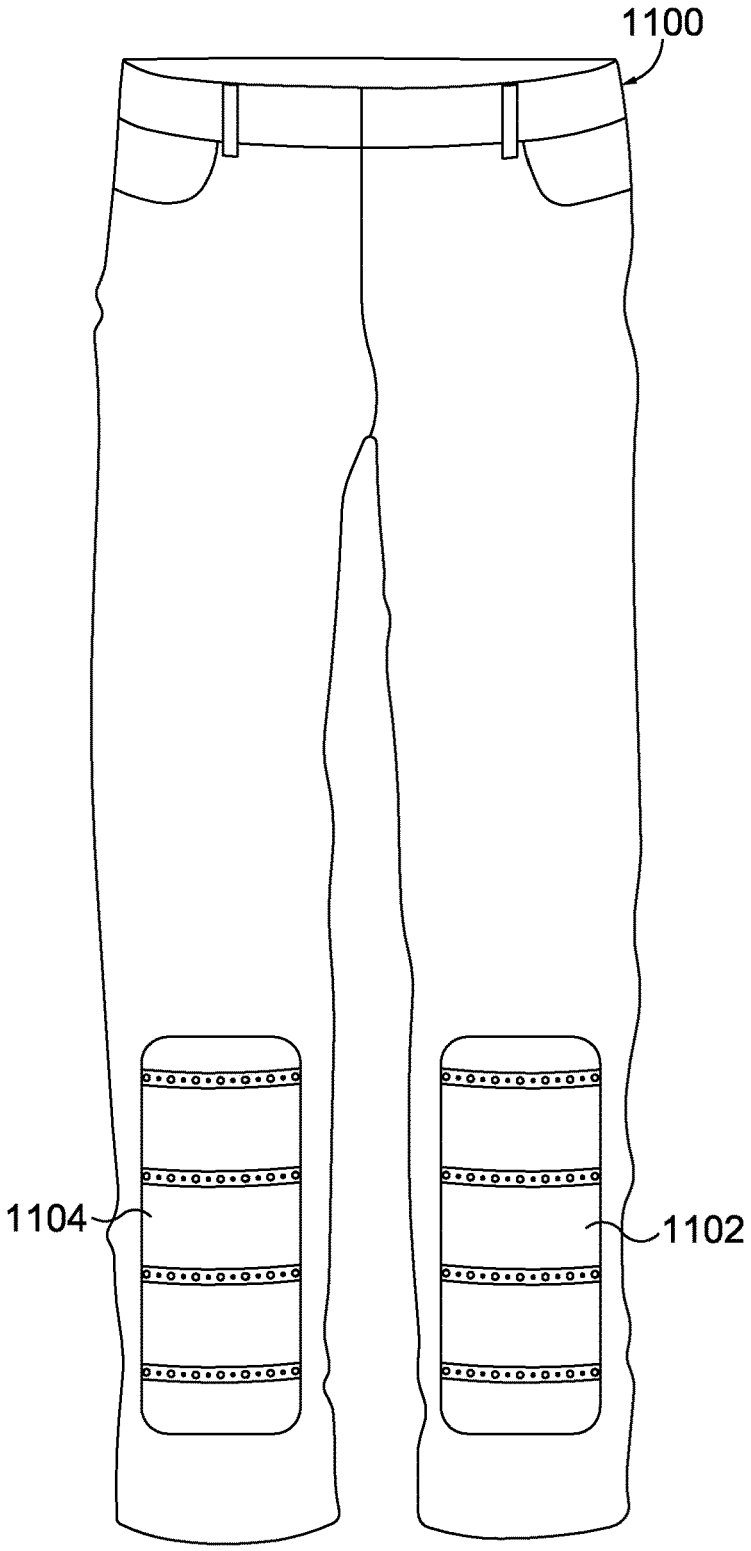
FIG. 11 is a view of vented pants with localized vented-insulation sections in accordance with the technology described herein.

Turning now to FIGS. 11-20, a number of exemplary configurations of insulation zones are depicted in accordance with aspects herein. The insulation zones shown in these figures have an exemplary exterior/interior opening configuration similar to that shown in, for example, FIG. 3 and/or FIGS. 5-7. For example, FIG. 11 depicts insulation zones within pants 1100. The right insulation zone 1104 and the left insulation zone 1102 are located in the shin areas, although aspects are not limited to these locations. Insulation zones may be installed in other pant locations.

Figure 12:
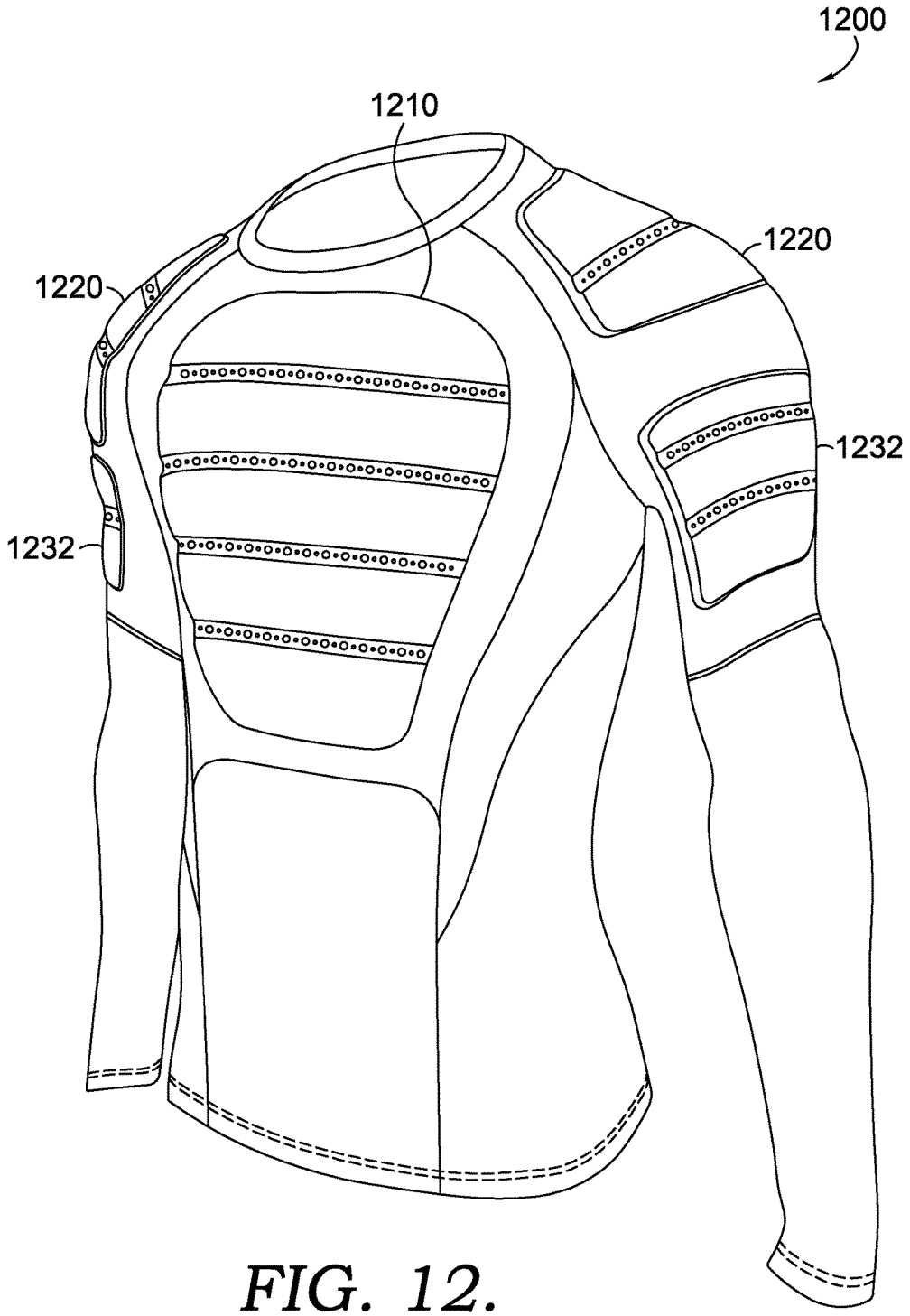
FIG. 12 is a front view of a vented top with localized vented-insulation sections in accordance with the technology described herein.
Figure 13:
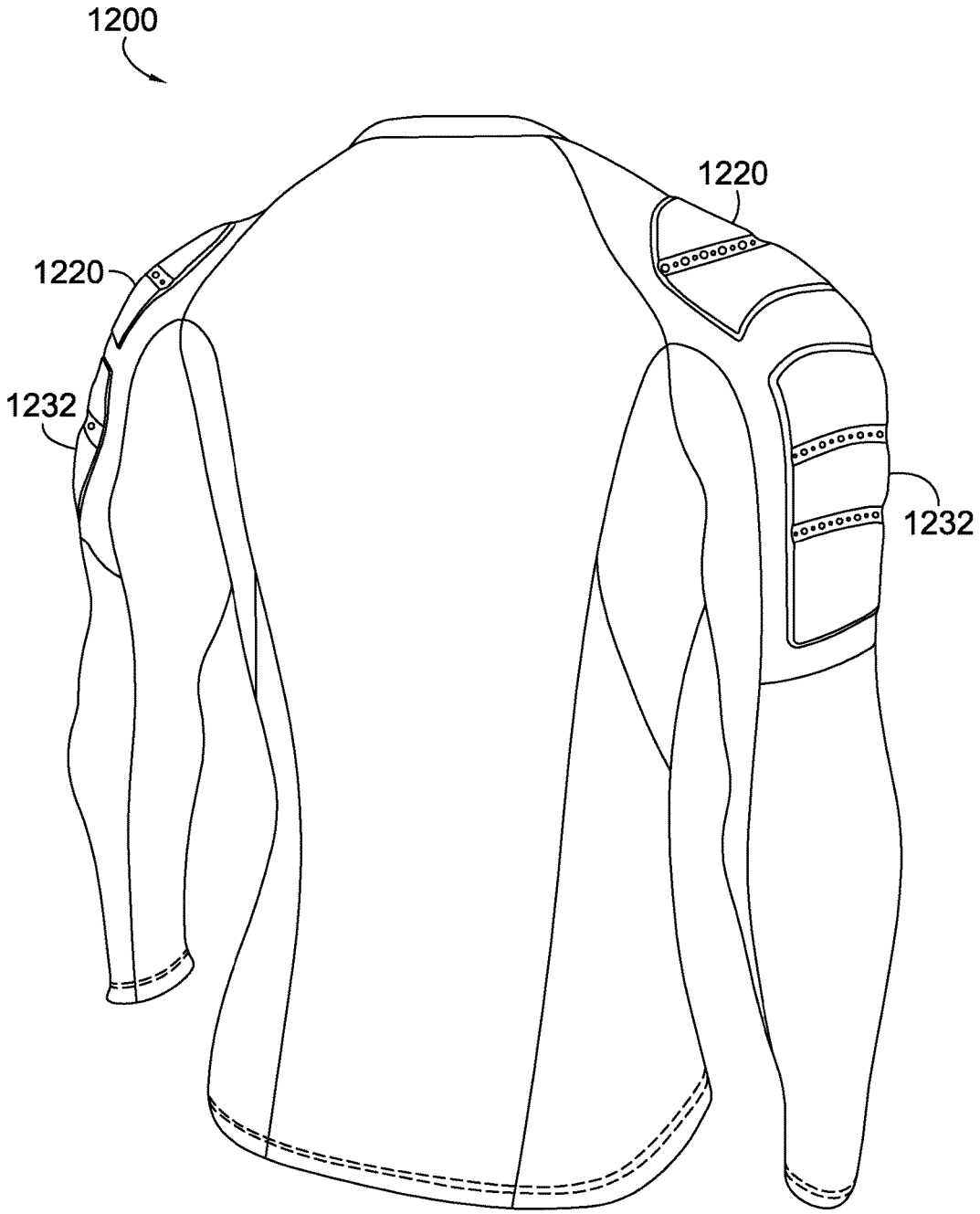
FIG. 13 is a back view of a vented top with localized vented-insulation sections in accordance with the technology described herein.

FIG. 12 depicts insulation zones within an athletic top 1200 in accordance with an aspect of the technology described herein. As shown in the perspective view of FIG. 12, the athletic top 1200 comprises a chest insulation zone 1210, right and left-shoulder insulation zones 1220, and upper right and left-arm insulation zones 1232. FIG. 13 depicts another perspective view of the athletic top 1200 and illustrates more clearly the right-shoulder insulation zone 1220 and the upper right-arm insulation zone 1232 in accordance with an aspect of the technology described herein.

Figure 14:
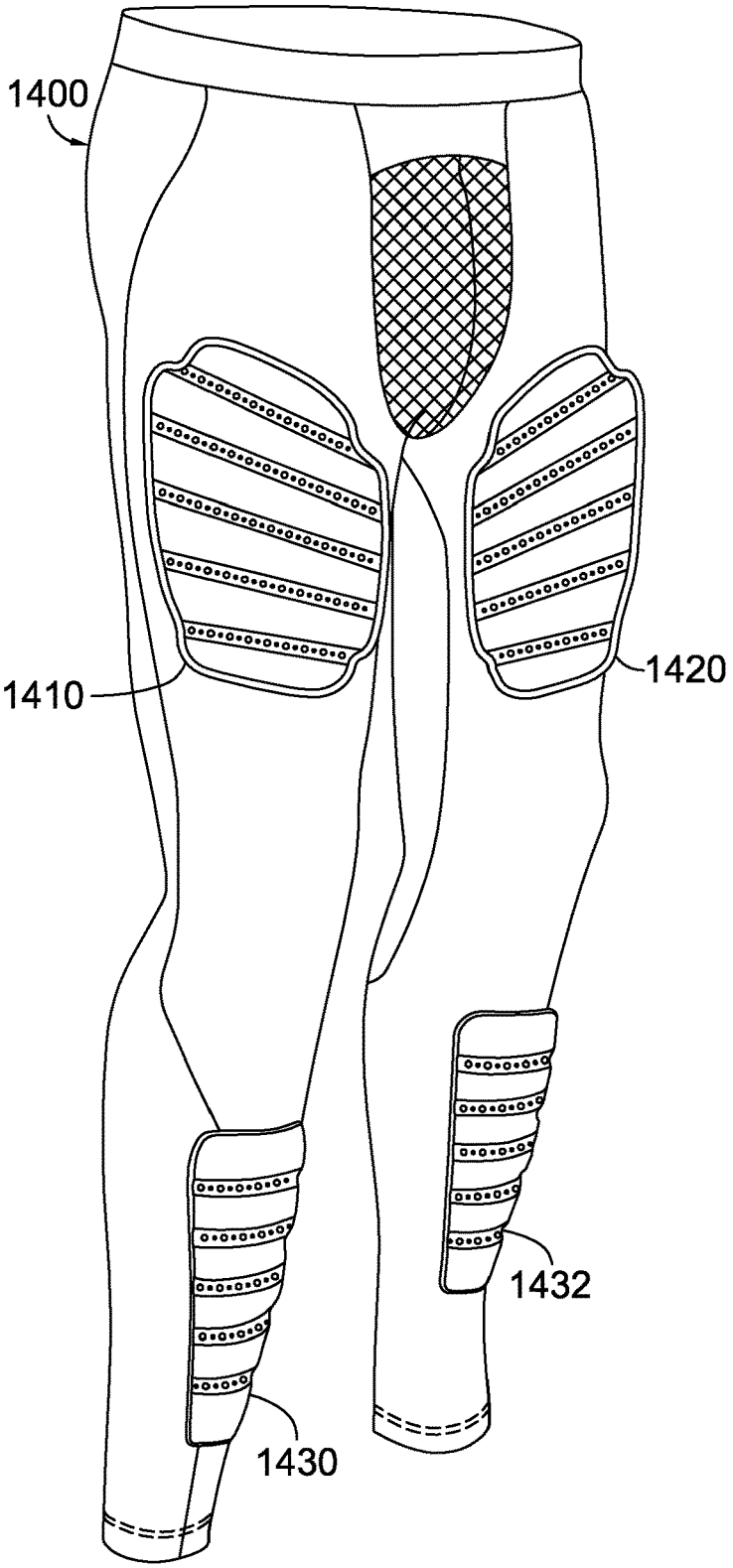
FIG. 14 is a perspective view of vented pants with localized vented-insulation sections in accordance with the technology described herein.
Figure 15:
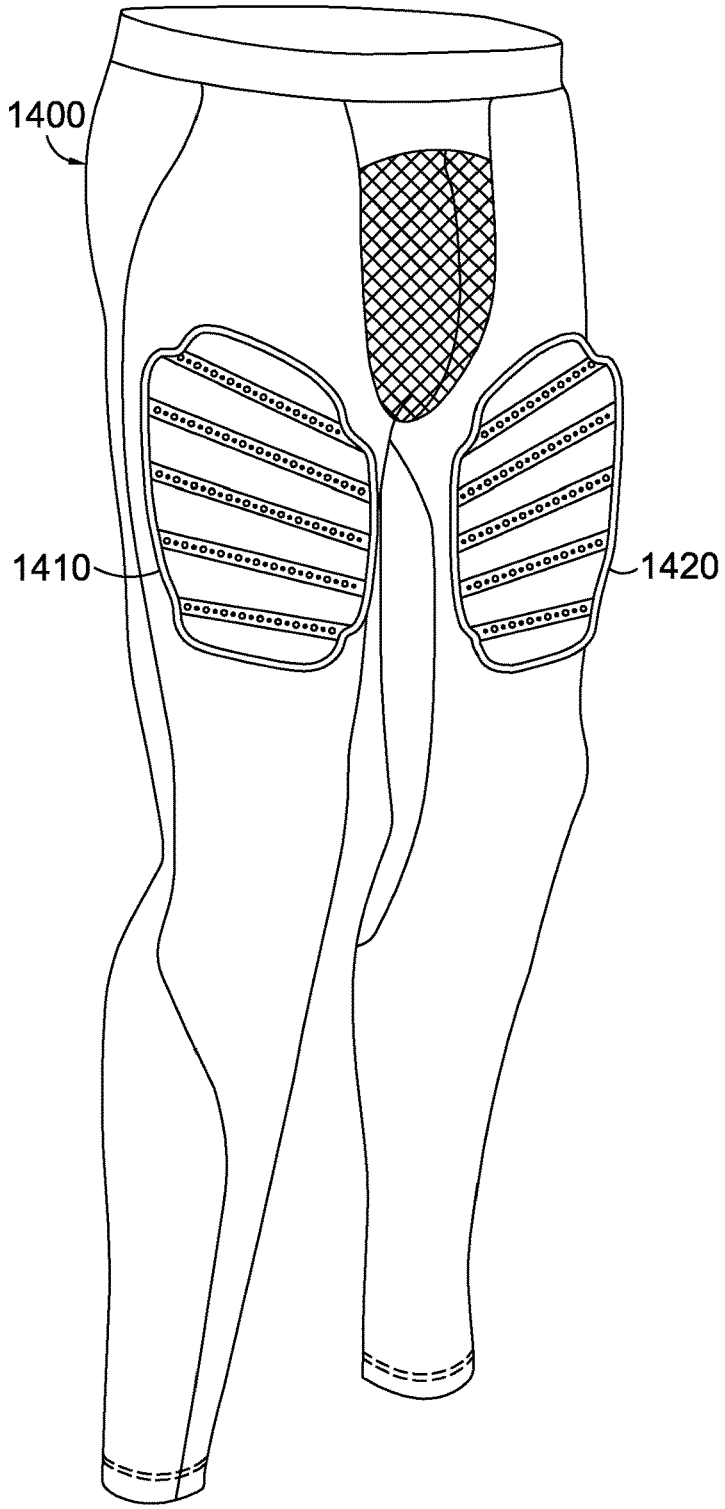
FIG. 15 is a perspective view of vented pants with localized vented-insulation sections in accordance with the technology described herein.

Turning now to FIG. 14, insulation zones within compression pants 1400 are shown, in accordance with an aspect of the technology described herein. The pants 1400 comprise a right-thigh insulation zone 1410 and a left-thigh insulation zone 1420. The pants 1400 also comprise a right-shin insulation zone 1430, and a left-shin insulation zone 1432. In exemplary aspect, the compression pant 1400 may comprise just the right-thigh insulation zone 1410 and the left-thigh insulation zone 1420. This aspect is shown in FIG. 15 which depicts compression pants 1500 having a right-thigh insulation zone 1510 and a left-thigh insulation zone 1520.

Figure 16:
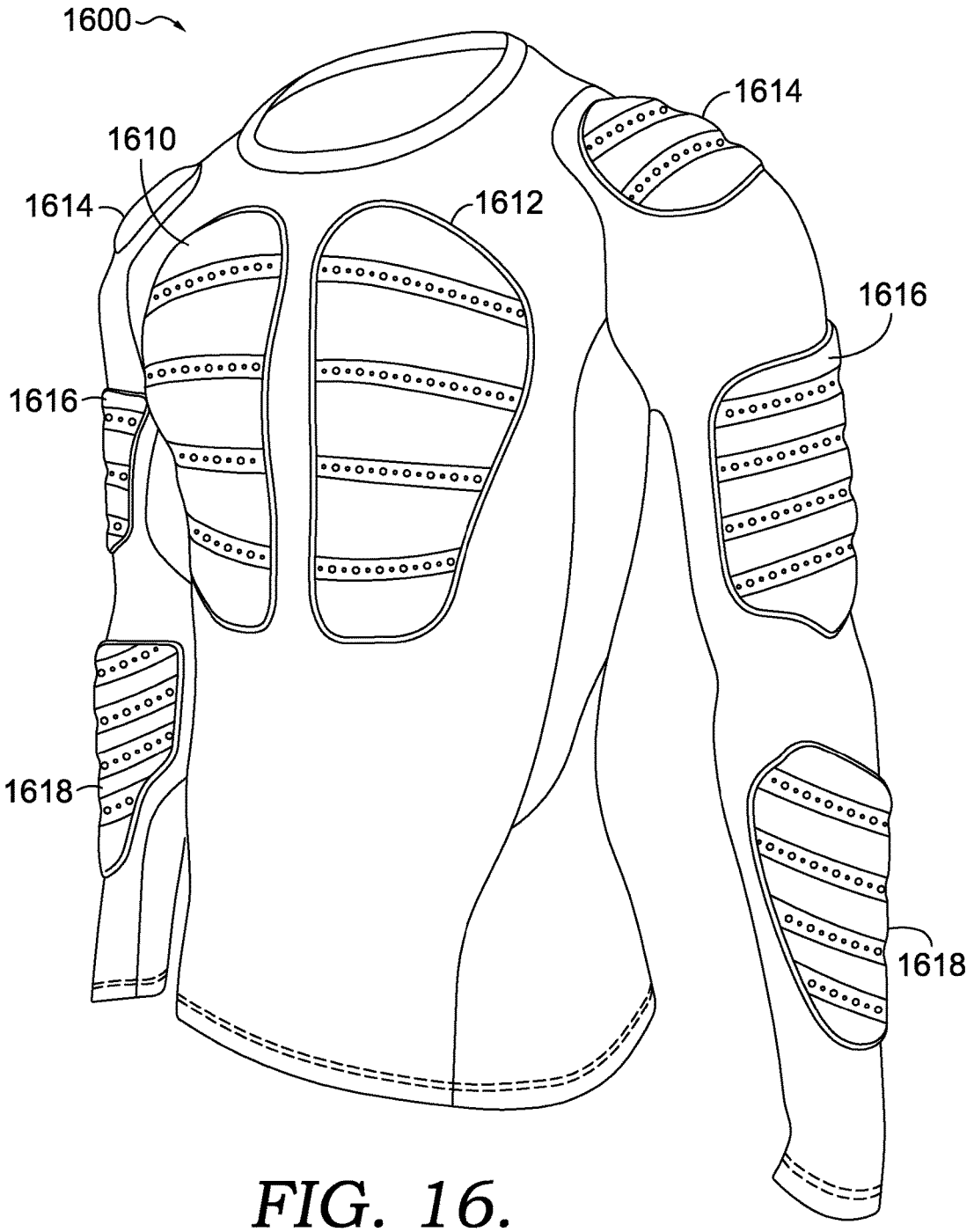
FIG. 16 is a front view of a vented top with localized vented-insulation sections in accordance with the technology described herein.
Figure 17:
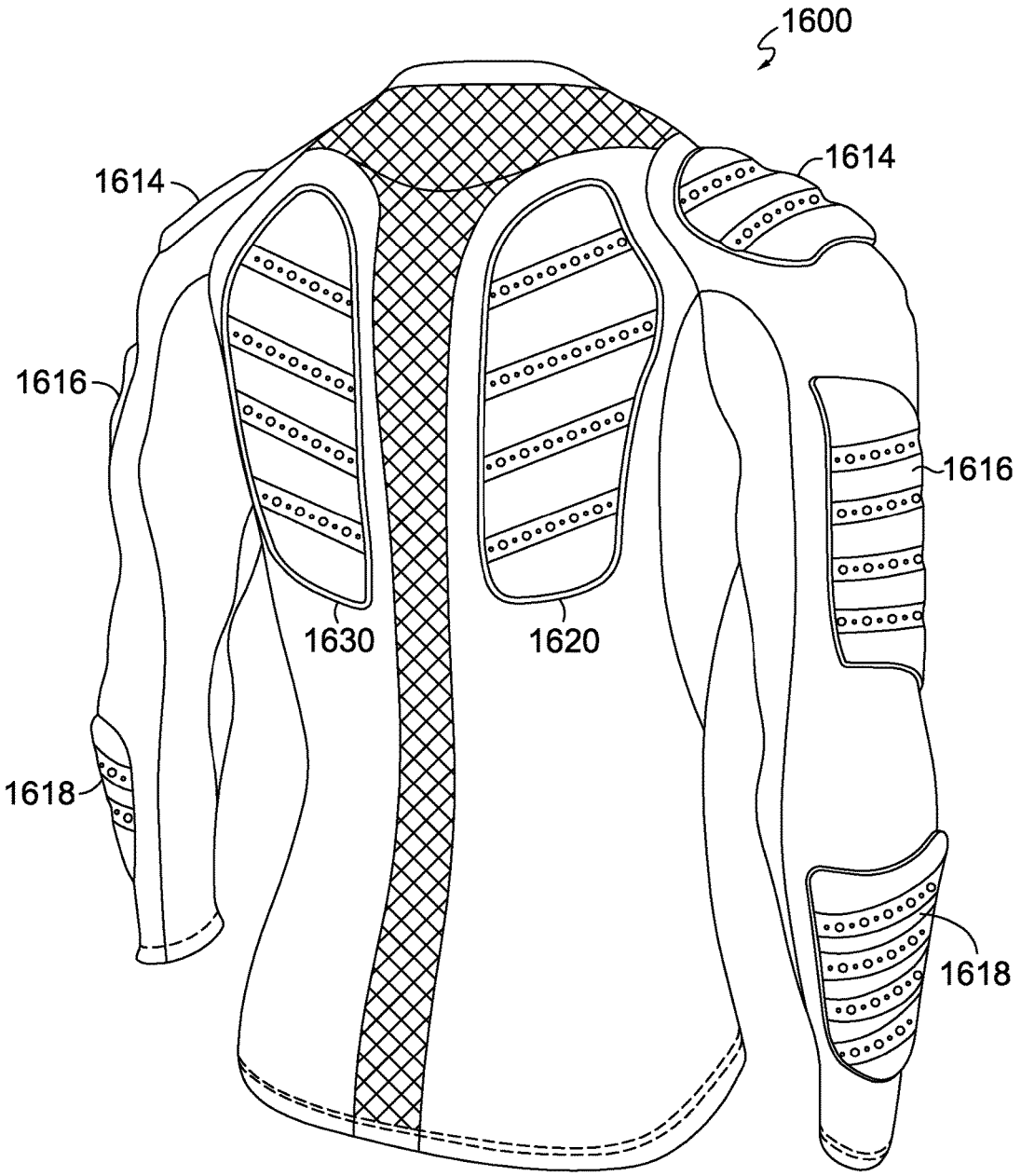
FIG. 17 is a back view of a vented top with localized vented-insulation sections in accordance with the technology described herein.

Turning now to FIG. 16, insulation zones within an athletic top 1600 are shown, in accordance with an aspect of the technology described herein. The athletic top 1600 comprises a right-chest insulation zone 1610 and a left-chest insulation zone 1612. The athletic top 1600 also comprises a left and right-shoulder insulation zones 1614, upper left and right-arm insulation zones 1616, and left and right-forearm insulation zones 1618. Turning now to FIG. 17, a rear-view of the athletic top 1600 illustrates a right-back insulation zone 1620 and a left-back insulation zone 1630, in accordance with an aspect of the technology described herein.

Figure 18:
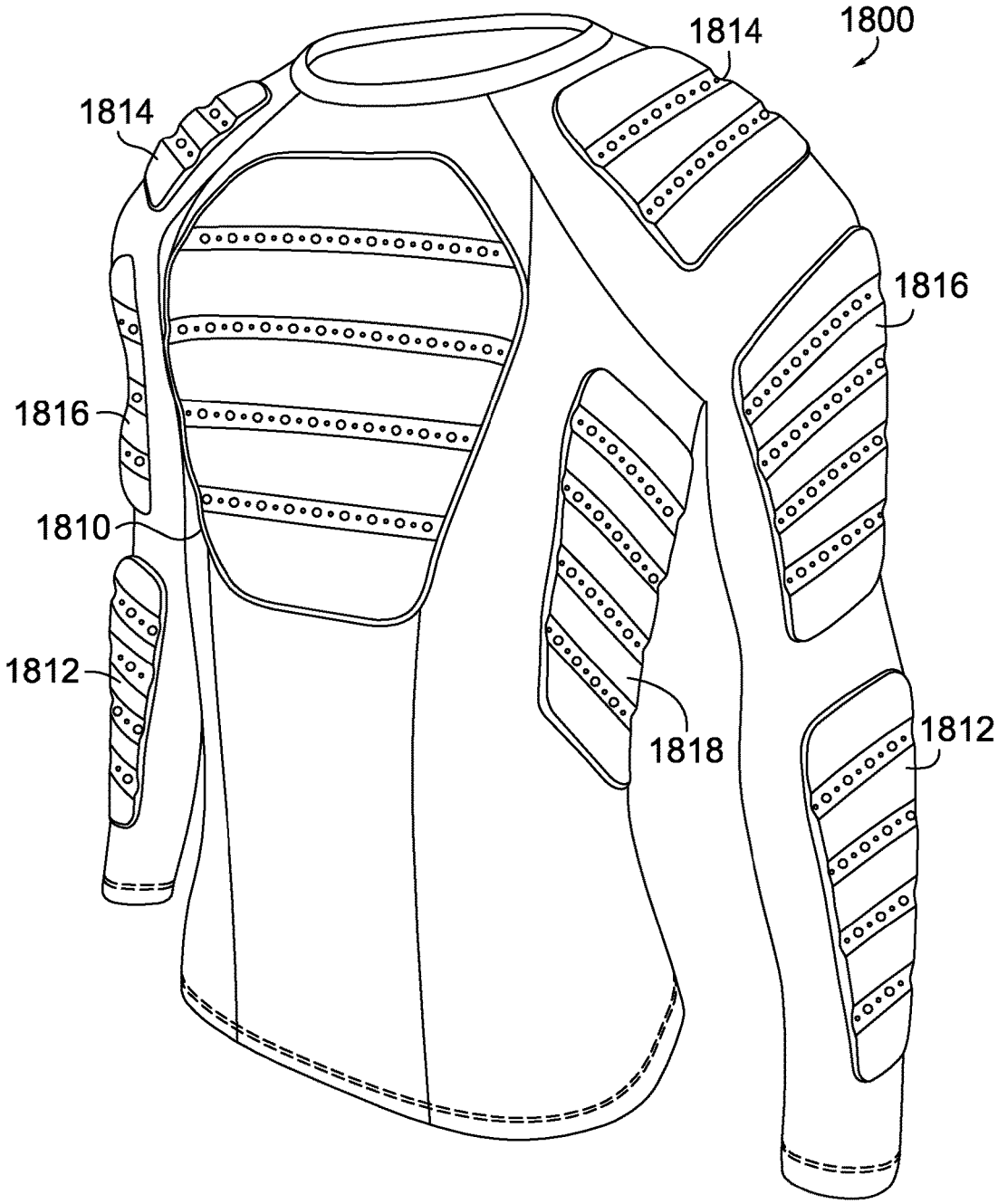
FIG. 18 is a front view of a vented top with localized vented-insulation sections in accordance with the technology described herein.
Figure 19:
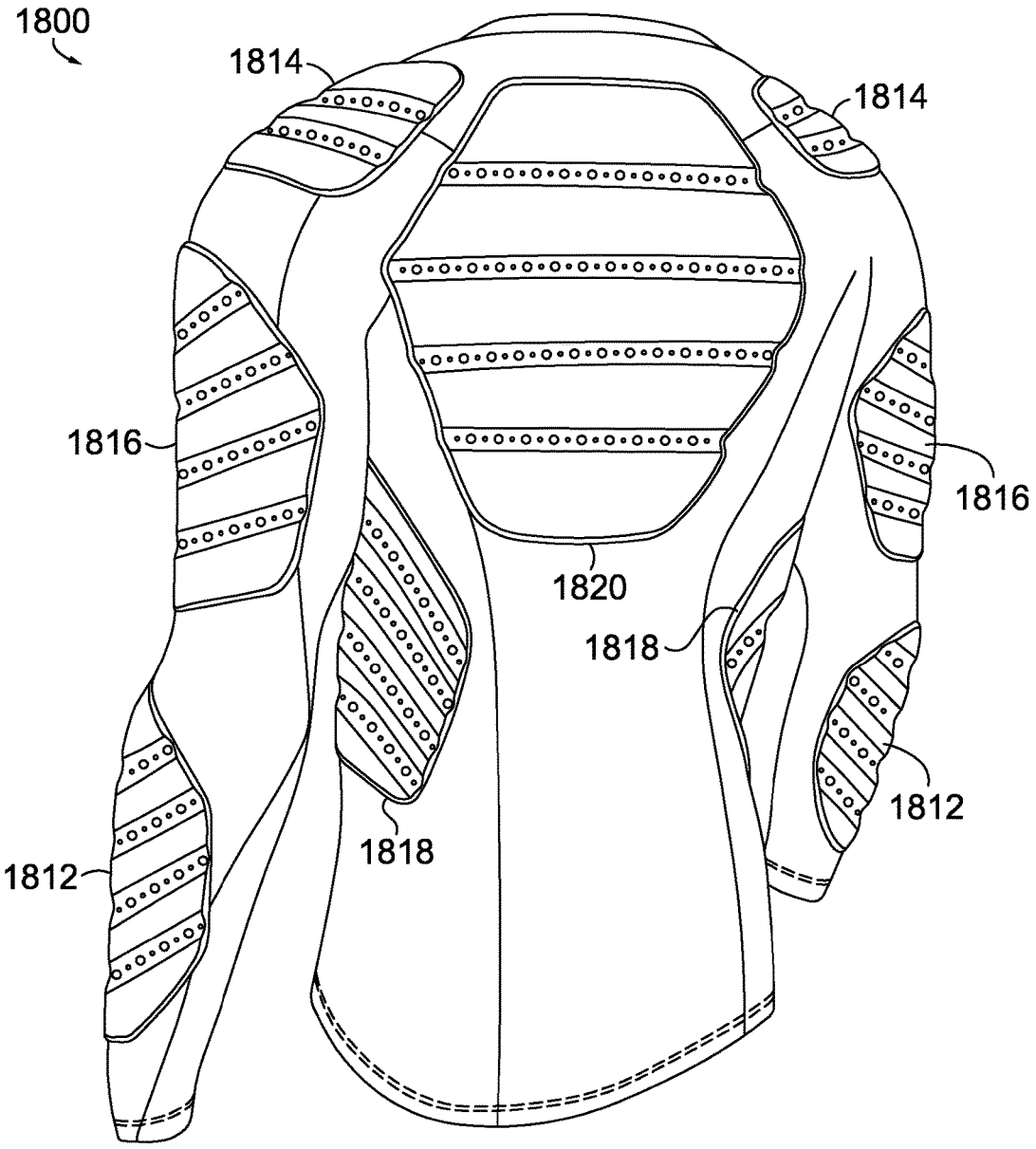
FIG. 19 is a back view of a vented top with localized vented-insulation sections in accordance with the technology described herein.

Turning now to FIG. 18, insulation zones within an athletic top 1800 are shown, in accordance with an aspect of the technology described herein. The athletic top 1800 comprises a chest insulation zone 1810, right and left-shoulder insulation zones 1814, upper right and left-arm insulation zones 1816, right and left-arm forearm insulation zones 1812, and right and left-side insulation zones 1818 (only the left-side insulation zone 1818 is shown in FIG. 18). Turning now to FIG. 19, a rear-view of the athletic top 1800 further shows a back insulation zone 1820 and the right-side insulation zone 1818 in accordance with an aspect of the technology described herein.

Figure 20:
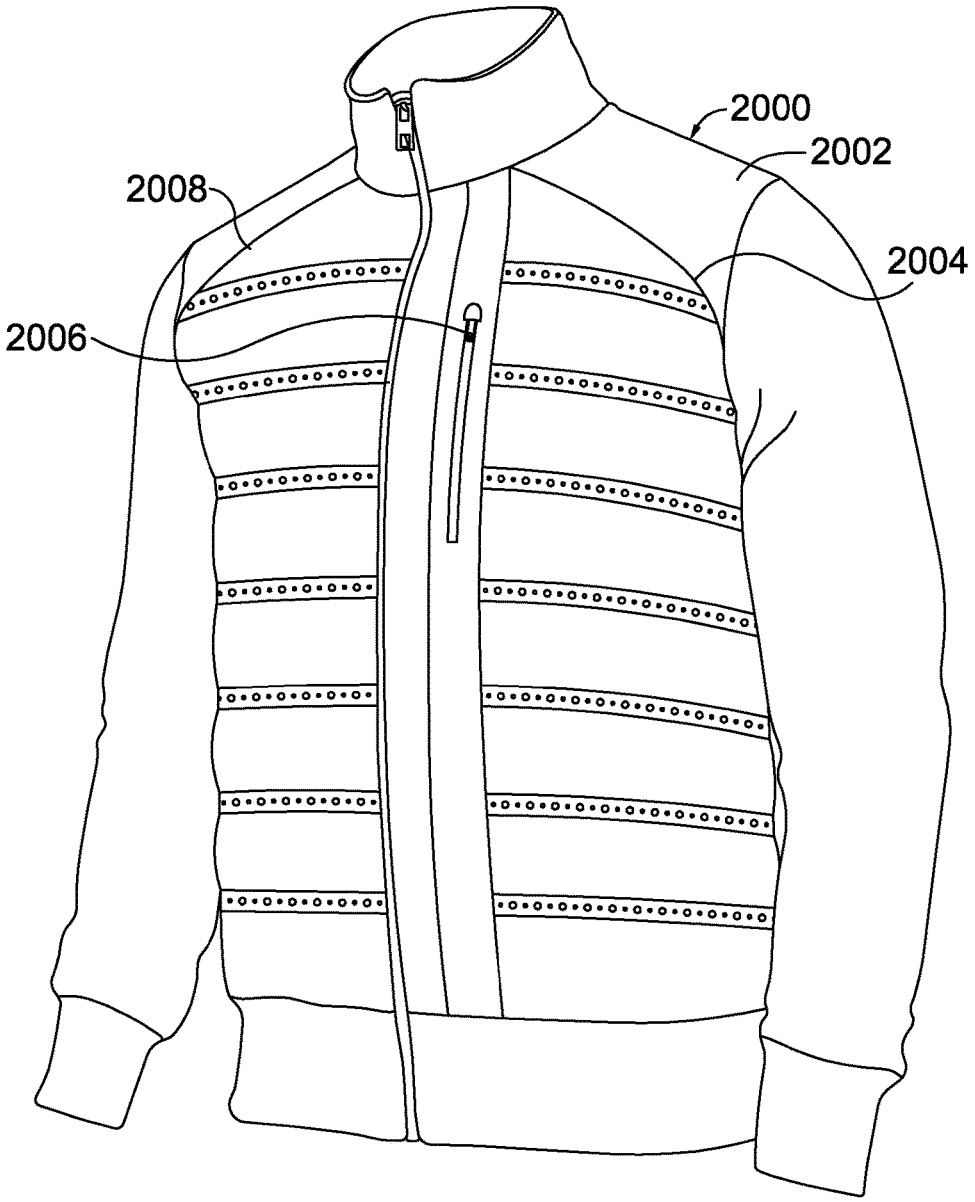
FIG. 20 is a front view of a vented fleece top with localized vented-insulation sections in accordance with the technology described herein.

Turning now to FIG. 20, insulation zones within a fleece top/jacket 2000 are shown, in accordance with an aspect of the technology described herein. The fleece jacket 2000 comprises a left-chest insulation zone 2004 and and a right-chest insulation zone 2008. The body 2002 of the fleece jacket 2000 may comprise a breathable fleece material. A zipper 2006 can provide entrance to a pocket (not shown). The pocket can be constructed of mesh or another breathable material that works with the insulation zone 2004 to facilitate the transfer of heat and moisture through the fleece jacket 2000.

Figure 21:
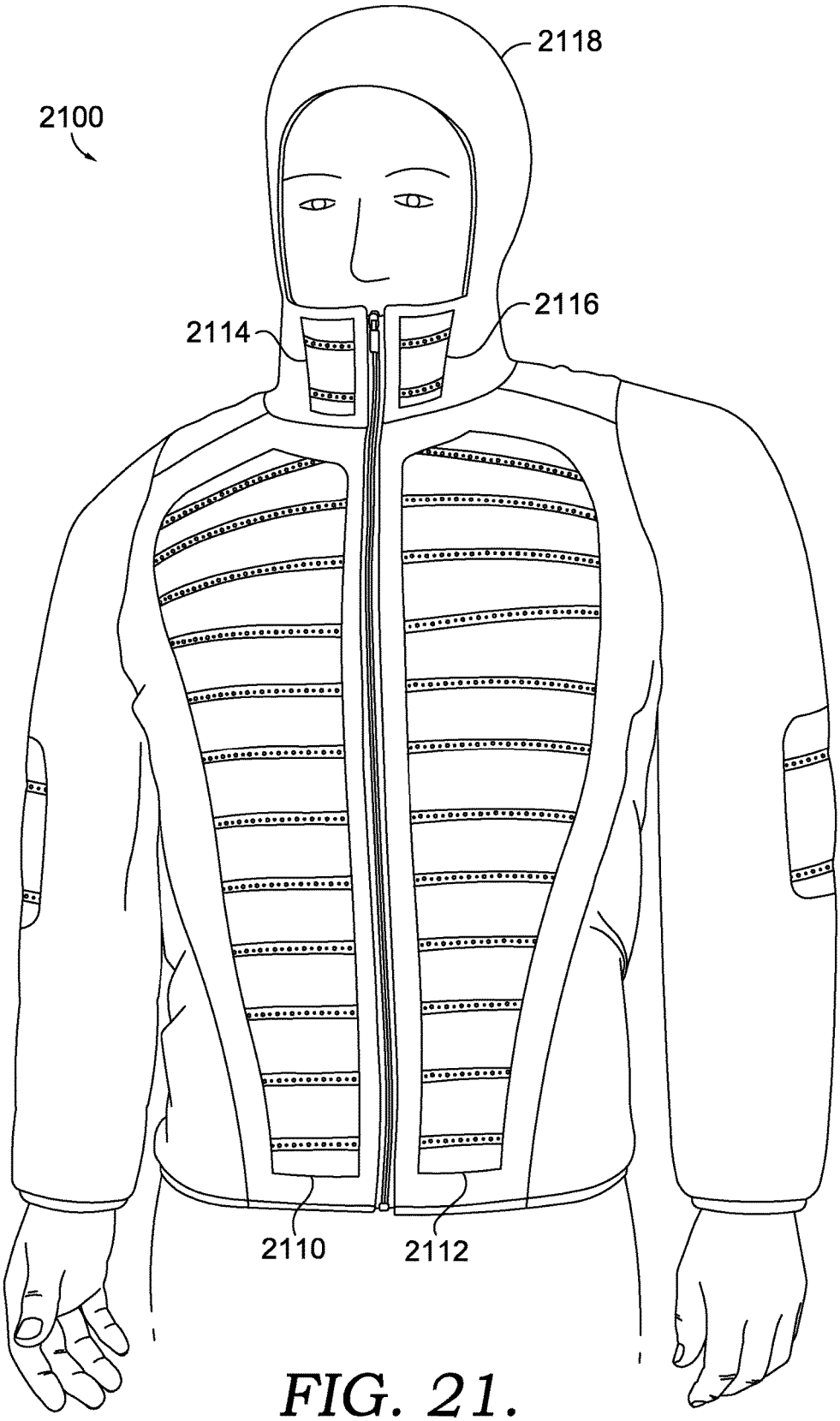
FIG. 21 is a front view of a vented jacket with a hood and localized vented-insulation sections in accordance with the technology described herein.

Turning now to FIG. 21, insulation zones within a hooded jacket 2100 are shown, in accordance with an aspect of the technology described herein. The hooded jacket 2100 comprises a left-chest insulation zone 2112 and a right-chest insulation zone 2110. The jacket 2100 may further comprise a hood 2118. The jacket 2100 also comprises a right-neck insulation zone 2114 and a left-neck insulation zone 2116, which might also align with a mouth and/or nose region of a wearer. As such, the right-neck insulation zone 2114 and the left-neck insulation zone 2116 might help to facilitate transfer of moisture, heat, and gas (e.g., carbon dioxide) away from a lower-face region of the wearer.

Figure 22:
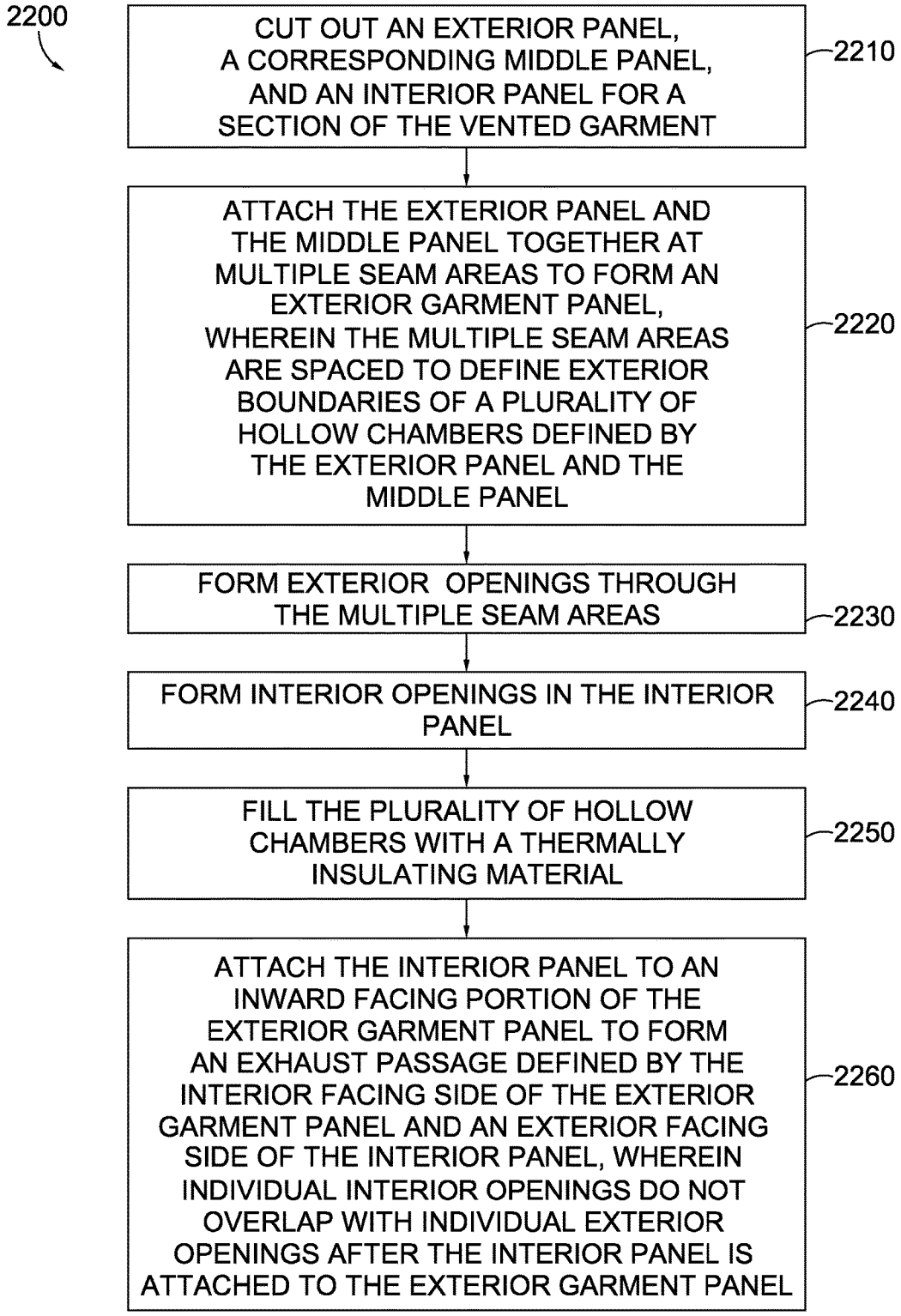
FIG. 22 is a flow chart showing an exemplary method of making a vented garment in accordance with the technology described herein.

Turning now to FIG. 22, flow chart showing an exemplary method 2200 of making a vented garment is provided. The vented garment could be a jacket, a vest, pants, full body suit, and the like and may comprise any of the configurations as described herein. At step 2210 an exterior panel, a corresponding middle panel, and an interior panel are cut out for a section of the vented garment. In an aspect, this process is repeated for each section of the garment and the sections, once completed at step 2260, are then connected to form the final vented garment.

At step 2220 the exterior panel and the middle panel are attached together at multiple seams to form an exterior garment panel. The multiple seams are spaced to define boundaries of a plurality of hollow chambers defined by the exterior panel and the middle panel. The hollow chambers can be different sizes and shapes to provide varying levels of insulation.

At step 2230 exterior openings through the multiple seams are formed. The exterior openings may have varying numbers as well as different sizes and/or different shapes. The openings can be formed via, for example, laser cutting, water jet cutting, mechanical cutting, and the like. Alternatively, when the panels are formed though an engineered weaving or knitting process, the openings may be formed through the weaving or knitting process. At step 2240, interior openings in the interior panel are formed through any of the methods outlined above. The interior openings can have different sizes and different shapes.

At step 2250 the plurality of hollow chambers defined by the seams are filled with a thermally-insulating material, such as down or other synthetic fibers.

At step 2260 the interior panel is attached to an inward-facing portion of the outer or exterior garment panel at one or more areas to form an exhaust passage or space defined by the interior-facing side of the outer or exterior garment panel and an exterior-facing side of the interior panel. In an exemplary aspect, individual interior openings generally do not overlap with individual exterior openings after the interior panel is affixed to the outer or exterior garment panel. In other words, the interior openings or offset from the exterior openings. The exterior and interior openings are connected by the exhaust passages or space between the interior panel and the exterior garment panel.

In one aspect, one or more portions of the vented garment are constructed using an engineered weaving or knitting process (e.g., program a weaving or knitting machine to form these structures). For example, the exterior panels and the interior panels may be formed together through the knitting and weaving process, where the knitting or weaving process may be used to form the seams and/or the exterior and interior openings. Any and all aspects, and any variation thereof, are contemplated as being within the scope herein.

In an alternative method of manufacture, an exterior panel and a corresponding interior panel may be cut out for a section of a garment. Exterior openings may be formed in the exterior panel and interior openings may be formed in the interior panel. The exterior panel and the interior panel may be joined together at one or more seam areas to form an exterior garment panel. The panels may be joined together by, for example, stitching or bonding or upper part of the seam and stitching or bonding a lower part of the seam, where the areas between the stitched or bonded portions remain unaffixed. The exterior panel and the interior panel are positioned or aligned prior to the stitching or bonding process so that the interior openings are offset from the exterior openings at the seam areas and so that the interior openings and the exterior openings are in communication with each other via the unaffixed areas between the stitched or bonded areas.

The one or more seam areas define and delineate one or more chambers which may be filled with a natural or synthetic fill material. The spacing between adjacent seams, in turn, defines the size of the chamber formed between the adjacent seams. As such, the spacing between seams may be adjusted to provide varying levels of insulation for different portions of the garment. Moreover, the spacing, size, and/or number of the exterior openings and the interior openings may be adjusted to facilitate greater or lesser amounts of moisture vapor and/or air transport. For example, the size and number of openings may be increased, and the spacing between openings decreased, to provide a greater amount of moisture vapor and/or air transport, while the size and number of openings may be decreased, and the spacing between openings increased, to provide a lesser amount of moisture vapor and/or air transport. Further, these variables may be adjusted corresponding to where the openings are positioned on the resultant garment. For example, moisture vapor and/or heat transport may be greater on portions of the garment that overlay high heat and/or moisture producing areas of the body such as the back torso along the spine, the flank areas of the wearer the chest area, the thigh or shin areas, the upper arm areas of the wearer, and the like. Continuing, the variables associated with the openings may also be adjusted depending on whether the resultant garment will be used for a male or a female as heat and/or moisture transport needs may differ between males and females. Any and all aspects, and any variation thereof, are contemplated as being within the scope herein.

It will be understood that certain features and subcombinations are of utility and may be employed without reference to other features and subcombinations. This is contemplated by and is within the scope of the claims.

Since many possible embodiments may be made of the technology described herein without departing from the scope thereof, it is to be understood that all matter herein set forth or shown in the accompanying drawings is to be interpreted as illustrative and not in a limiting sense.

The invention claimed is:

1. A vented garment comprising
- an interior panel comprising a weather-resistant material and having a plurality of interior openings; and
- an exterior panel comprising a weather-resistant material and having a plurality of exterior openings located within a seam area, the exterior panel being attached to the interior panel at a location that causes individual exterior openings not to overlap with individual interior openings.

2. The vented garment of claim 1, wherein the exterior panel and the interior panel comprise a fabric/textile that weighs 89 g/m2 or less.

3. The vented garment of claim 1, further comprising
- a chamber defined by a middle panel and the exterior panel, the middle panel located between the interior panel and the exterior panel; and
- a thermally-insulating fill material contained within the chamber.

4. The vented garment of claim 3, wherein the thermally-insulating fill material comprises a synthetic fiber.

5. The vented garment of claim 3, wherein the middle panel and the exterior panel are attached at least at the seam area, the seam area created with an adhesive tape activated by an application of energy.

6. The vented garment of claim 1, wherein the plurality of interior openings are not located within the seam area.

7. A vented garment comprising:
- a vented-insulation section that comprises:
  - an interior panel comprising a weather-resistant material and defining a plurality of interior openings; and
  - an exterior panel comprising a weather-resistant material and defining a plurality of exterior openings located within a seam area, the exterior panel being attached to the interior panel at a location that causes individual exterior openings not to overlap with individual interior openings.

8. The vented garment of claim 7, wherein the interior panel and the exterior panel comprise a fabric/textile that weighs 89 g/m2 or less.

9. The vented garment of claim 7, further comprising
- a chamber defined by a middle panel and the exterior panel, the middle panel located between the interior panel and the exterior panel; and
- a thermally-insulating fill material contained within the chamber.

10. The vented garment of claim 7, further comprising a non-moisture resistant panel attached to an inward-facing side of the interior panel, the non-moisture resistant panel comprising one of a mesh material, a moisture wicking material, or a moisture managing fabric.

11. The vented garment of claim 7, wherein the vented-insulation section comprises less than 50% of the vented garment's exterior surface.

12. The vented garment of claim 9, wherein the seam area is formed when the middle panel and the exterior panel are attached.

13. The vented garment of claim 12, wherein the plurality of interior openings are not located within the seam area formed when the middle panel and the exterior panel are attached.

14. A method of making a vented garment comprising:
- providing an exterior panel, a corresponding middle panel, and an interior panel for a section of the vented garment;

attaching the exterior panel and the middle panel together at multiple seam areas to form an exterior garment panel, wherein the multiple seam areas are spaced to define exterior boundaries of a plurality of hollow chambers defined by the exterior panel and the middle panel;

forming exterior openings through the multiple seam areas;

forming interior openings in the interior panel;

filling the plurality of hollow chambers with a thermally-insulating fill material; and attaching the interior panel to an inward-facing portion of the exterior garment panel to form an exhaust passage defined by the interior-facing side of the exterior garment panel and an exterior-facing side of the interior panel, wherein individual interior openings do not overlap with individual exterior openings after the interior panel is attached to the exterior garment panel.

15. The method of claim 14, wherein the thermally-insulating fill material is down.

16. The method of claim 14, wherein the exterior panel, the middle panel, and the interior panel are formed through a weaving or knitting process.

17. The method of claim 14, wherein the exterior openings are formed intermittently along the multiple seam areas.

18. The method of claim 14, wherein at least one of the exterior openings or the interior openings have different sizes.

19. The method of claim 14, wherein at least one of the exterior openings or the interior openings have different shapes.

* * * * *